US009599920B2

(12) United States Patent
Sugahara et al.

(10) Patent No.: US 9,599,920 B2
(45) Date of Patent: Mar. 21, 2017

(54) MAGNETIC CARRIER AND TWO-COMPONENT DEVELOPER

(71) Applicant: CANON KABUSHIKI KAISHA, Tokyo (JP)

(72) Inventors: Nobuyoshi Sugahara, Tokyo (JP); Hironori Minagawa, Moriya (JP); Yuto Onozaki, Shimotsuma (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/831,139

(22) Filed: Aug. 20, 2015

(65) Prior Publication Data

US 2016/0062257 A1 Mar. 3, 2016

(30) Foreign Application Priority Data

Aug. 26, 2014 (JP) ..... 2014-171139
Aug. 18, 2015 (JP) ..... 2015-161033

(51) Int. Cl.
*G03G 9/113* (2006.01)
*G03G 9/107* (2006.01)

(52) U.S. Cl.
CPC ..... *G03G 9/1133* (2013.01); *G03G 9/1075* (2013.01); *G03G 9/1135* (2013.01)

(58) Field of Classification Search
CPC ..... G03G 9/1133
USPC ..... 430/111.35, 111.31
See application file for complete search history.

(56) References Cited

U.S. PATENT DOCUMENTS

| | | | | |
|---|---|---|---|---|
| 5,512,402 | A | 4/1996 | Okado et al. | |
| 5,670,288 | A | 9/1997 | Okado et al. | |
| 6,077,635 | A | 6/2000 | Okado et al. | |
| 6,372,400 | B1 | 4/2002 | Yoshizaki et al. | |
| 7,144,668 | B2 | 12/2006 | Baba et al. | |
| 7,279,262 | B2 | 10/2007 | Fujikawa et al. | |
| 7,544,457 | B2 | 6/2009 | Hashimoto et al. | |
| 7,816,063 | B2 | 10/2010 | Hashimoto et al. | |
| 8,628,905 | B2 | 1/2014 | Kobayashi et al. | |
| 2009/0087771 | A1* | 4/2009 | Sawada | G03G 9/107 430/110.2 |
| 2010/0183970 | A1* | 7/2010 | Tsurumi | G03G 9/107 430/110.3 |
| 2010/0330492 | A1* | 12/2010 | Tsurumi | G03G 9/1075 430/111.1 |
| 2012/0322004 | A1* | 12/2012 | Shoji | G03G 9/1136 430/111.1 |
| 2013/0040236 | A1* | 2/2013 | Fukushima | G03G 15/09 430/125.3 |
| 2014/0051022 | A1* | 2/2014 | Shoji | G03G 9/1133 430/110.2 |
| 2014/0134535 | A1 | 5/2014 | Baba et al. | |
| 2014/0302435 | A1* | 10/2014 | Veregin | G03G 9/1133 430/110.2 |
| 2015/0241807 | A1 | 8/2015 | Sugahara et al. | |
| 2015/0268577 | A1 | 9/2015 | Takahashi et al. | |

FOREIGN PATENT DOCUMENTS

| | | | |
|---|---|---|---|
| EP | 2 299 327 | A1 | 3/2011 |
| JP | 62-121463 | A | 6/1987 |
| JP | 4-198946 | A | 7/1992 |
| JP | 7-104522 | A | 4/1995 |
| JP | 9-127736 | A | 5/1997 |
| JP | 2001-75315 | A | 3/2001 |
| JP | 2006-337579 | A | 12/2006 |
| JP | 2008233763 | A * | 10/2008 |
| JP | 2009-139707 | A | 6/2009 |
| JP | 2013044766 | A * | 3/2013 |

OTHER PUBLICATIONS

English language machine translation of JP 2013-044766 (Mar. 2013).*
English language machine translation of JP 2008-233763 (Oct. 2008).*
European Search Report dated Jan. 27, 2016 in European Application No. 15182301.0.

* cited by examiner

*Primary Examiner* — Christopher Rodee
(74) *Attorney, Agent, or Firm* — Fitzpatrick, Cella, Harper & Scinto

(57) ABSTRACT

The present invention is a magnetic carrier that has a magnetic carrier core and a resin coat layer, wherein the resin coat layer contains a coat resin A and a coat resin B, the coat resin A is a polymer obtained by polymerization of a (meth)acrylate ester monomer that has an alicyclic hydrocarbon group, the coat resin B is a polymer obtained by polymerization of (meth)acrylic monomer and has a polar group and an acid value of 4.0 to 50.0 mg KOH/g, the content of the coat resin A is 10 to 90 mass %, the content of the coat resin B is 10 to 90 mass %, and an acid value of the resin component in the resin coat layer is 1.0 to 10.0 mg KOH/g.

8 Claims, 4 Drawing Sheets

MAGNETIC CARRIER AND TWO-COMPONENT DEVELOPER

BACKGROUND OF THE INVENTION

Field of the Invention

The present invention relates to a magnetic carrier and a two-component developer for use in an image-forming method that has a step in which an electrostatic latent image (electrostatic image) is developed (visualized) by an electrophotographic method.

Description of the Related Art

Electrophotographic methods have in recent years been used in image-forming apparatuses such as copiers and printers. Image-forming apparatuses that use an electrophotographic method must be able to support the output of a variety of images, such as fine lines, small characters, photographs, and full-color images. In addition, higher image qualities, higher definitions, higher image output speeds, and longer continuous runs are also being required.

The magnetic carrier used in the two-component developers that satisfy these requirements have taken the form of light composite particles with a specific gravity approximately from 2.0 to 5.0 and have little ability to fracture the toner even at higher image output speeds and longer continuous runs.

In order, in particular, to achieve a higher image quality for full-color images, a magnetic carrier must exhibit an excellent charge-providing ability for small particle diameter toners.

Thus, it is important for a magnetic carrier that it imparts a uniform amount of charge to the toner, that it is resistant to changes in the amount of charge imparted to the toner even during long-term use, and that environmental fluctuations do not cause changes in the amount of charge imparted to the toner (small environmental differences). A magnetic carrier that exhibits these properties must also have an excellent durability. As an example of these carriers, Japanese Patent Application Laid-open No. 2006-337579 describes a magnetic carrier that has improved durability by light-weighting of the carrier.

With regard to art that improves the durability of magnetic carriers, Japanese Patent Application Laid-open No. H7-104522 describes a magnetic carrier that has a silicone resin coat layer containing, for example, a silane coupling agent, disposed on the surface of a magnetic core material particle. Japanese Patent Application Laid-open No. S62-121463 describes a magnetic carrier provided by treating the surface of a magnetic core material particle with a coupling agent and then coating with a silicone resin. Japanese Patent Application Laid-open No. H4-198946 describes a magnetic carrier provided by treating the surface of a magnetic core material particle with an aminosilane coupling agent and then applying a coat layer containing a resin having a functional group capable of reacting with the aminosilane coupling agent.

In addition, a lightweight composite particle is commonly obtained by constructing a magnetic carrier core from a magnetic body component and a resin component. However, variations in the tinge and variations in the image density due to changes in the environment from a low-humidity environment to a high-humidity environment are one problem that can be caused by the use of a resin component for the magnetic carrier core. This is thought to be caused by the moisture adsorbability of the resin component.

With regard to the art of restraining the amount of moisture adsorption by a magnetic carrier particle, Japanese Patent Application Laid-open No. 2001-075315, Japanese Patent Application Laid-open No. H9-127736, and Japanese Patent Application Laid-open No. 2009-139707 describe art in which the amount of moisture adsorption by the magnetic carrier particle is regulated or specified.

However, recent years have seen demands for additional improvements in the durability of the magnetic carrier. There have also been demands for magnetic carriers to exhibit a greater suppression of the variations in image density and tinge that are induced by environmental fluctuations.

SUMMARY OF THE INVENTION

To respond to the requirements listed above, an object of the present invention is to provide a magnetic carrier that can be used in a two-component developer that is capable, even when environmental fluctuations occur, of the long-term output of high-quality images. A further object of the present invention is to provide a two-component developer that contains this magnetic carrier.

The present invention is a magnetic carrier that has a magnetic carrier core and a resin coat layer formed on the surface of the magnetic carrier core, wherein the resin coat layer contains a coat resin A and a coat resin B; the coat resin A is a polymer obtained by polymerization of a (meth) acrylate ester monomer that has an alicyclic hydrocarbon group; the coat resin B is a polymer obtained by polymerization of (meth)acrylic monomer, has a polar group, and has an acid value of from 4.0 mg KOH/g to 50.0 mg KOH/g; the coat resin A is contained in the resin coat layer at from 10 mass % to 90 mass % with reference to the mass of the resin component in the resin coat layer; the coat resin B is contained in the resin coat layer at from 10 mass % to 90 mass % with reference to the mass of the resin component in the resin coat layer; and the acid value of the resin component in the resin coat layer is from 1.0 mg KOH/g to 10.0 mg KOH/g.

The present invention is also a two-component developer that has a toner and the aforementioned magnetic carrier of the present invention.

The present invention can provide a magnetic carrier that can be used in a two-component developer that is capable, even when the magnetic carrier is subjected to stress such as environmental fluctuations and long-term continuous use, of the long-term output of high-quality images. The present invention can also provide a two-component developer that contains this magnetic carrier.

Further features of the present invention will become apparent from the following description of exemplary embodiments (with reference to the attached drawings).

DESCRIPTION OF THE EMBODIMENTS

Figure 1:
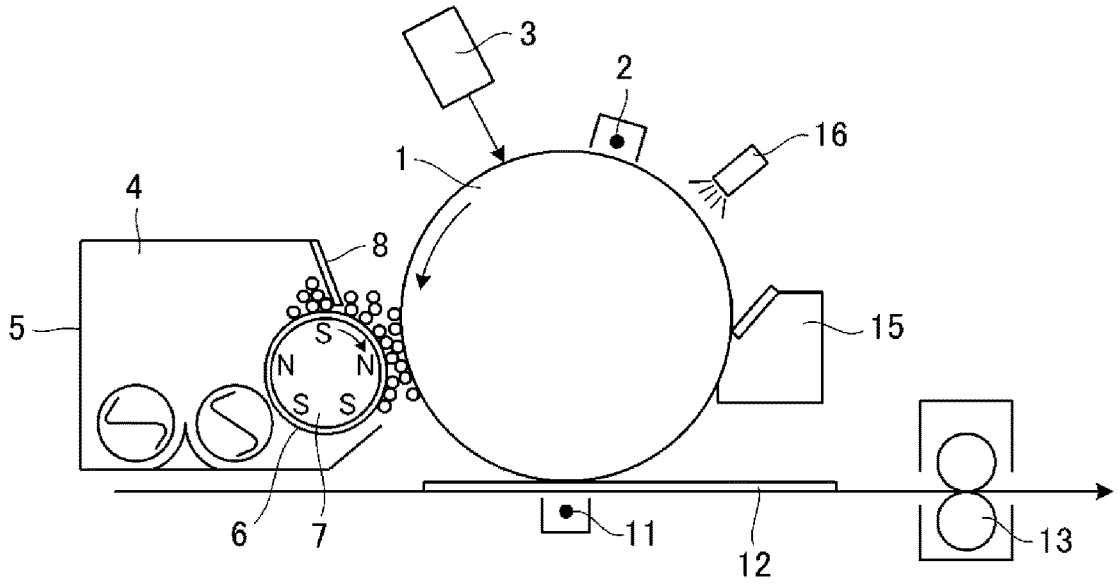
FIG. 1 is a schematic diagram of an image-forming apparatus that can use the magnetic carrier of the present invention.

The resin coat layer on the magnetic carrier of the present invention contains a coat resin A and a coat resin B. This coat resin A is a polymer obtained by polymerizing monomer that contains a (meth)acrylate ester monomer that has an alicyclic hydrocarbon group. The coat resin B is obtained by polymerizing (meth)acrylic monomer, has a polar group, and has an acid value from 4.0 mg KOH/g to 50.0 mg KOH/g. This coat resin A and coat resin B are preferably mixed in the resin coat layer and preferably have a satisfactory compatibility.

The role of the resin coat layer of a magnetic carrier is to enable a stable charging of the toner (charge-providing ability) on a long-term basis. One requirement for this is that the surface of the magnetic carrier be resistant to contamination by attached material originating from the toner. Another is that the resin coat layer have a high film strength and the surface of the resin coat layer be resistant to alteration by stresses such as friction. The use of a fluorine-containing acrylic resin or a silicone resin in the resin coat layer of the magnetic carrier is one method for responding to these requirements. Contamination of the magnetic carrier surface by attached material originating from the toner is inhibited by using these resins in the resin coat layer.

However, when these resins are used in the resin coat layer of a magnetic carrier, and when the image-forming apparatus (copier) is continually used under severe conditions of use, e.g., variation of the resin coat layer by environmental fluctuations, stress to the magnetic carrier by continuous image output, and so forth, the resin coat layer undergoes shaving and exfoliation, which interferes with the output image. This is believed to be due to the relatively hard and brittle character exhibited by the fluorine-containing acrylic resin and silicone resin.

During the course of investigating this problem, the present inventors discovered that, by using a (meth)acrylic resin that had an alicyclic hydrocarbon group, the surface of the resin coat layer (coating film surface) on the magnetic carrier could be made uniform and contamination by attached material originating from the toner could be inhibited.

However, the present inventors carried out additional investigations in pursuit of a charge-providing ability that would be stable for an even longer time period under severe conditions of use.

It was found that the adhesiveness between the resin coat layer and the magnetic carrier core is improved when a polar group having a certain acid value is present in the coat resin. The present inventors consider this to be an effect from an interaction between the polar group in the coat resin and the magnetic carrier core and/or the resin used in the magnetic carrier core. By this interaction, the adhesiveness between the resin coat layer and the magnetic carrier core is kept even when swelling or shrinking of the resin occurs by environmental fluctuations of humidity.

Investigations were therefore carried out into polymers (coat resins) obtained by the copolymerization of monomer having an alicyclic hydrocarbon group and monomer that confers a certain acid value on the polymer.

However, substantial effects were not obtained to the extent anticipated by the present inventors. As a result of investigations by the present inventors, it was discovered here that the coating film uniformity of the resin coat layer declined as the storage time period after polymer synthesis grew longer. The present inventors hypothesized that, due to the influence of the structure deriving from the monomer that provides the polymer with the certain acid value, a tendency is set up wherein self-aggregation of the polymer occurs, which impairs the ability of the surface of the resin coat layer to become smooth (uniform).

Based on this result, it was discovered that the effect from the monomer having an alicyclic hydrocarbon group and the effect from the monomer that provides the acid value are both satisfactorily obtained by having the resin coat layer of the magnetic carrier be a resin coat layer that contains a polymer (coat resin A) obtained by the polymerization of a (meth)acrylate ester monomer that has an alicyclic hydrocarbon group, and a polymer (coat resin B) obtained by the polymerization of (meth)acrylic monomer that provides the polymer with the certain acid value. The present invention was achieved based on this discovery.

Thus, the resin coat layer possessed by the magnetic carrier of the present invention contains a polymer (coat resin A) obtained by the polymerization of monomer that contains a (meth)acrylate ester monomer that has an alicyclic hydrocarbon group, and a polymer (coat resin B) obtained by the polymerization of (meth)acrylic monomer, wherein this polymer has a polar group and has an acid value of 4.0 mg KOH/g to 50.0 mg KOH/g.

The alicyclic hydrocarbon group-containing (meth)acrylate ester monomer used in the synthesis of the coat resin A causes the surface (coating film surface) of the resin coat layer coating the magnetic carrier core surface to be smooth and thus functions to inhibit the attachment of toner and toner-derived components, e.g., the external additives that impart flowability to the toner, and suppress reductions in the ability to impart charge to the toner. When the alicyclic hydrocarbon group-containing (meth)acrylate ester monomer is absent, image defects are readily generated during long-term use—particularly in a high-temperature, high-humidity environment—due to a reduction in the ability to impart charge to the toner.

The alicyclic hydrocarbon group-containing (meth)acrylate ester monomer can be exemplified by cyclobutyl acrylate, cyclopentyl acrylate, cyclohexyl acrylate, cycloheptyl acrylate, dicyclopentenyl acrylate, dicyclopentanyl acrylate, cyclobutyl methacrylate, cyclopentyl methacrylate, cyclohexyl methacrylate, cycloheptyl methacrylate, dicyclopentenyl methacrylate, and dicyclopentanyl methacrylate. A single one of these monomers may be used or two or more may be used.

The alicyclic hydrocarbon group-containing (meth)acrylate ester monomer is preferably used in the synthesis of the coat resin A at from 50 mass parts to 90 mass parts where the total monomer used in the synthesis of the coat resin A is 100 mass parts.

The weight-average molecular weight (Mw) of the coat resin A is preferably from 20,000 to 120,000 and more preferably from 30,000 to 100,000 from the viewpoint of coating stability.

The acid value of the coat resin A is preferably from 0 mg KOH/g to 3.0 mg KOH/g, more preferably from 0 mg KOH/g to 2.8 mg KOH/g, and even more preferably from 0 mg KOH/g to 2.5 mg KOH/g. When the acid value of the coat resin A is not more than 3.0 mg KOH/g, the occurrence of self-aggregation of the resin under the influence of the acid value is suppressed and reductions in the smoothness of the resin coat layer surface (coating film surface) are inhibited. The acid value of the coat resin A can be controlled by using a monomer that contains a polar group, e.g., the carboxy group, sulfo group (sulfonic acid group), and so forth, in the synthesis of the coat resin A and adjusting the amount of addition of this monomer. However, since the coat resin A preferably has a low acid value, a polar group-bearing monomer is preferably not used. A minor acid value may also be produced in the synthesized resin when a resin is synthesized using only monomers that form the ester bond. This is believed to be due to the production of carboxy groups due to scission of some of the ester bonds during resin synthesis (during polymerization).

The coat resin A is preferably a polymer (copolymer) obtained by the copolymerization of a macromonomer with an alicyclic hydrocarbon group-containing (meth)acrylate ester monomer. The use of a macromonomer in the synthesis of the coat resin A improves the adhesiveness between the resin coat layer and the magnetic carrier core and improves the ability of the magnetic carrier to provide charge to the toner.

This macromonomer is preferably a macromonomer obtained by the polymerization of at least one selection from the group consisting of methyl acrylate, methyl methacrylate, butyl acrylate, butyl methacrylate, 2-ethylhexyl acrylate, 2-ethylhexyl methacrylate, styrene, acrylonitrile, and methacrylonitrile.

The weight-average molecular weight (Mw) of the macromonomer is preferably from 2,000 to 10,000 and more preferably from 3,000 to 8,000.

The macromonomer is preferably used in the synthesis of the coat resin A in the range from 5.0 mass parts to 40.0 mass parts where the total monomer used for the synthesis of the coat resin A is 100 mass parts.

The acid value of the coat resin B is from 4.0 mg KOH/g to 50.0 mg KOH/g in the present invention. From 4.5 mg KOH/g to 40.0 mg KOH/g is preferred. When the acid value is at least 4.0 mg KOH/g, the adhesiveness between the resin coat layer and the magnetic carrier core is improved, the ability to provide charge to the toner is stabilized, and variations in the amount of charge provided to the toner are suppressed even when fluctuations in the environment occur. When the acid value is not more than 50.0 mg KOH/g, moisture absorption by the resin coat layer is suppressed, the ability to provide charge to the toner is stabilized during long-term use particularly in a high-temperature and high-humidity environment, and, for example, the image density becomes stable.

The (meth)acrylic monomer used in the synthesis of the coat resin B is preferably a (meth)acrylic monomer that has a polar group that can provide the coat resin B with its acid value. Polar groups that can provide the coat resin B with its acid value can be exemplified by the carboxy group and the sulfo group. (Meth)acrylic monomers that bear such a polar group can be exemplified by acrylic acid and methacrylic acid. The acid value of the coat resin B is raised by increasing the proportion of the polar group-bearing monomer, e.g., acrylic acid, methacrylic acid, and so forth, in the total monomer used to synthesize the coat resin B. Due to this, the acid value of the coat resin B can be controlled by adjusting the ratio between the polar-group bearing monomer and monomer that does not have a polar group.

The weight-average molecular weight (Mw) of the coat resin B is preferably from 30,000 to 120,000 and more preferably from 40,000 to 100,000 from the viewpoint of coating stability.

The resin coat layer possessed by the magnetic carrier of the present invention preferably resides in a state in which the coat resin A is mixed with the coat resin B.

The content of the coat resin A in the resin coat layer in the present invention is from 10 mass % to 90 mass % with reference to the mass of the resin component of the resin coat layer. In addition, the content of the coat resin B in the resin coat layer is from 10 mass % to 90 mass % with reference to the mass of the resin component of the resin coat layer. When the content of the coat resin A is less than 10 mass %, or when the content of the coat resin B is less than 10 mass %, it is then difficult to achieve a smooth resin coat layer surface (coating film surface), and adhesion between the resin coat layer and the magnetic carrier core is impaired. Preferably the coat resin A is from 30 mass % to 70 mass % with reference to the mass of the resin component in the resin coat layer and the coat resin B is from 30 mass % to 70 mass % with reference to the mass of the resin component in the resin coat layer.

Even better effects can be manifested in the present invention by mixing the two resins when the magnetic carrier core surface is coated with the coat resin A and the coat resin B (for example, when the resin solution for the coating operation is prepared), and this is therefore preferred. It was found that the strength (coating film strength) of the resin coat layer is higher when the coat resin A and the coat resin B are mixed than when the coat resin A and the coat resin B are each coated separately on the magnetic carrier core. While the specifics of the reason for this are unclear, the present inventors hypothesize that the strength (coating film strength) of the resin coat layer is enhanced due to an increase in the adhesiveness between polymer molecules brought about by the electron-donating character of the alicyclic hydrocarbon group of the coat resin A and the electron-withdrawing character of the polar group of the coat resin B.

Self-aggregation of the resin (polymer) readily occurs when the alicyclic hydrocarbon group and the polar group for providing the acid value are present together in a single polymer molecule. Due to this, even when such a polymer is present in the resin coat layer, it is difficult to obtain the effect of smoothing the resin coat layer surface (coating film surface) and the effect of generating a satisfactory adhesion between the resin coat layer and the magnetic carrier core.

The mixing of the coat resin A with the coat resin B immediately before coating the magnetic carrier core is particularly preferred in the present invention. By doing this, the aggregation of the coat resin A and the coat resin B can be minimized and a more stable provision of charge to the toner can be achieved even when the image-forming apparatus (copier) is continually used under severe use conditions, e.g., fluctuations in the environment and continuous image output.

The acid value of the resin component of the resin coat layer is preferably from 1.0 mg KOH/g to 10.0 mg KOH/g. From 1.0 mg KOH/g to 5.0 mg KOH/g is more preferred, and from 2.0 mg KOH/g to 5.0 mg KOH/g is even more preferred. The coat resin A and the coat resin B are also incorporated in the resin component of the resin coat layer. An improved adhesiveness between the resin coat layer and the magnetic carrier core, an enhanced resin coat layer strength (coating film strength), and an improved ability to provide charge to the toner can be achieved by having the acid value of the resin component of the resin coat layer be in the range from 1.0 mg KOH/g to 10.0 mg KOH/g.

When the acid value of the resin component of the resin coat layer is at least 1.0 mg KOH/g, the adhesiveness between the resin coat layer and the magnetic carrier core is improved. Moreover, the ability to provide charge to the toner is stabilized and fluctuations in the amount of charge provided to the toner are suppressed even when environmental fluctuations occur. When the acid value of the resin component of the resin coat layer is not more than 10.0 mg KOH/g, moisture absorption by the resin coat layer is inhibited, and the ability to provide charge to the toner and, for example, the image density are stabilized during long-term use and particularly in a high-temperature, high-humidity environment. The acid value of the resin component of the resin coat layer can be controlled, for example, by adjusting the mixing ratio between the coat resin A and the coat resin B present in the resin component.

Viewed from the perspective of the stability of the resin coat layer surface (coating film surface), the minimum value of the storage elastic modulus (G') of the resin component of the resin coat layer in the range from 70° C. to 100° C. is preferably from $7.0\times10^7$ Pa to $1.0\times10^9$ Pa. The minimum value of the storage elastic modulus (G') is more preferably from $9.0\times10^7$ Pa to $8.0\times10^8$ Pa.

Also viewed from the perspective of the stability of the resin coat layer surface (coating film surface), the minimum value of the loss elastic modulus (G") of the resin component of the resin coat layer in the range from 70° C. to 100° C. is from $1.0\times10^6$ Pa to $1.0\times10^8$ Pa. The minimum value of the loss elastic modulus (G") is more preferably from $2.0\times10^6$ Pa to $8.4\times10^7$ Pa.

When the minimum value of the storage elastic modulus (G') in the range from 70° C. to 100° C. is at least $7.0\times10^7$ Pa and the minimum value of the loss elastic modulus (G") is at least $1.0\times10^6$ Pa, softening of the resin coat layer surface (coating film surface) is suppressed and the reduction in the ability to provide charge to the toner as brought about by toner-derived attached material is inhibited. When the minimum value of the storage elastic modulus (G') in the range from 70° C. to 100° C. is not more than $1.0\times10^9$ Pa and the minimum value of the loss elastic modulus (G") is not more than $1.0\times10^8$ Pa, coating may then be easily carried out in the step in which the magnetic carrier core is coated with the coat resin A and the coat resin B. As a result of the preceding, the resin coat layer surface (coating film surface) is readily made smooth and the appearance of effects on the output image is suppressed.

A higher glass transition temperature (Tg) for the coat resin A and/or a higher glass transition temperature (Tg) for the coat resin B provides a larger storage elastic modulus (G') for the resin component of the resin coat layer. The Tg can be controlled by adjusting the type of monomer used in the synthesis of the coat resin A and the coat resin B and by adjusting the molecular weight of the coat resin A and the coat resin B. As a result, the minimum value of the storage elastic modulus (G') in the range from 70° C. to 100° C. can be controlled by controlling the Tg of the coat resin A and the coat resin B and by controlling the mixing ratio between the two.

In addition, the loss elastic modulus (G") of the resin component of the resin coat layer can be increased when the polarity, e.g., the acid value, the molecular weight, and the Tg of the coat resin A are increased and/or when the polarity, e.g., the acid value, the molecular weight, and the Tg of the coat resin B are increased. As a result, the minimum value of the loss elastic modulus (G") in the range from 70° C. to 100° C. can be controlled by adjusting the polarity, molecular weight, and Tg of the coat resin A and/or the coat resin B.

Moreover, by mixing the coat resin A and the coat resin B, the storage elastic modulus (G') and the loss elastic modulus (G") may in some cases also be raised through interactions, e.g., hydrogen bonding, between the polymer molecules. The storage elastic modulus (G') and the loss elastic modulus (G") of the resin component of the resin coat layer may also be adjusted considering such cases.

The following are examples of monomers that may be used—in addition to and in combination with the monomers respectively specified above—in the synthesis of the coat resin A and the coat resin B: methyl acrylate, ethyl acrylate, propyl acrylate, isopropyl acrylate, normal-butyl acrylate, isobutyl acrylate, tert-butyl acrylate, 2-ethylhexyl acrylate, lauryl acrylate, dodecyl acrylate, tridecyl acrylate, tetradecyl acrylate, pentadecyl acrylate, hexadecyl acrylate, heptadecyl acrylate, octadecyl acrylate, methyl methacrylate, ethyl methacrylate, propyl methacrylate, isopropyl methacrylate, normal-butyl methacrylate, isobutyl methacrylate, tert-butyl methacrylate, 2-ethylhexyl methacrylate, lauryl methacrylate, dodecyl methacrylate, tridecyl methacrylate, tetradecyl methacrylate, pentadecyl methacrylate, hexadecyl methacrylate, heptadecyl methacrylate, and octadecyl methacrylate.

The magnetic carrier core used in the magnetic carrier of the present invention is described in the following.

The magnetic carrier core is not particularly limited and currently used general magnetic carrier core can be used. The magnetic carrier core is preferably a magnetic body-dispersed resin particle, in which a magnetic body component is dispersed in a resin component, or a porous magnetic core particle that contains resin in the voids. These can restrain the load imposed on the toner because they enable a lowering of the true density of the magnetic carrier. As a result, even during long-term use, deterioration in the image quality can be suppressed and the exchange frequency for a developer containing toner and carrier (two-component developer) can be reduced.

The magnetic body-dispersed resin particle will be described first.

The magnetic body component present in the magnetic body-dispersed resin particle can be exemplified by magnetite particles; maghemite particles; magnetic iron oxide particles provided by the incorporation in the preceding of at least one selection from the group consisting of the oxides of silicon, the hydroxides of silicon, the oxides of aluminum, and the hydroxides of aluminum; magnetoplumbite-type ferrite particles that contain barium, strontium, or barium and strontium; and spinel-type ferrite particles that contain at least one selection from the group consisting of manganese, nickel, zinc, lithium, and magnesium. Magnetic iron oxide particles are preferred among the preceding.

The following nonmagnetic body components (nonmagnetic inorganic compound particles) may also be used in the magnetic body-dispersed resin particle in addition to the magnetic body component: nonmagnetic iron oxide particles such as hematite particles, nonmagnetic hydrated ferric oxides such as goethite, titanium oxide particles, silica particles, talc particles, alumina particles, barium sulfate particles, barium carbonate particles, cadmium yellow particles, calcium carbonate particles, and zinc oxide particles.

When the magnetic body component is used in combination with a nonmagnetic body component (nonmagnetic inorganic compound particles), the proportion of the magnetic body component in their mixture is preferably at least 30 mass %.

All or a portion of the magnetic body component is preferably treated in the present invention with a lipophilizing treatment agent.

The lipophilizing treatment agent can be exemplified by organic compounds that have at least one functional group selected from the group consisting of the epoxy group, amino group, mercapto group, organic acid groups, ester groups, ketone groups, halogenated alkyl groups, and aldehyde groups, and by mixtures of the preceding.

A coupling agent is preferred for the functional group-bearing organic compound. Silane coupling agents, titanium coupling agents, and aluminum coupling agents are more preferred, and silane coupling agents are even more preferred.

A thermosetting resin is preferred for the resin component constituting the magnetic body-dispersed resin particle.

The thermosetting resin can be exemplified by phenolic resins, epoxy resins, and unsaturated polyester resins. Phenolic resins are preferred thereamong from the standpoint of ease of acquisition (price and ease of production). The phenolic resins can be exemplified by phenol-formaldehyde resins.

With regard to the proportions between the resin component, and magnetic body component (and optionally nonmagnetic inorganic compound particles) that constitute the magnetic body-dispersed resin particle, the resin component is preferably from 1 mass % to 20 mass % and the magnetic body component (and optionally nonmagnetic inorganic compound particles) is preferably from 80 mass % to 99 mass %.

Methods for producing the magnetic body-dispersed resin particle are described in the following.

The magnetic body-dispersed resin particle can be produced, for example, by the method described in the examples below. Thus, in this method, for example, a phenol and an aldehyde are first stirred in an aqueous medium in the presence of a basic catalyst and the magnetic body component, e.g., magnetic iron oxide particles. The phenol and aldehyde are then reacted and cured to produce magnetic body-dispersed resin particles that contain a phenolic resin and the magnetic body component, e.g., magnetic iron oxide particles.

The magnetic body-dispersed resin particles can also be produced by a method, a so-called kneading pulverization method, in which a resin that contains the magnetic body component, e.g., magnetic iron oxide particles, is pulverized.

The former method is preferred in terms of the ease of control of the particle diameter of the magnetic carrier and achieving a sharp particle size distribution for the magnetic carrier.

The porous magnetic core particle will be described next.

The material of the porous magnetic core particle can be exemplified by magnetite and ferrite. Ferrite is preferred therebetween based on the ease of control of the porous structure of the porous magnetic core particle and the ease of adjusting the resistance of the porous magnetic core particle.

Ferrite is a sintered compact given by the following general formula $$(M1_2O)_x(M2O)_y(Fe_2O_3)_z$$

(in this general formula, M1 is a monovalent metal; M2 is a divalent metal; and $0 \leq x \leq 0.8$, $0 \leq y \leq 0.8$, and $0.2 < z < 1.0$ where $x+y+z=1.0$).

M1 and M2 in this general formula can be exemplified by Li, Fe, Mn, Mg, Sr, Cu, Zn, Ca, Ni, Co, Ba, Y, V, Bi, In, Ta, Zr, B, Mo, Na, Sn, Ti, Cr, Al, Si, and rare earths.

In order to maintain a suitable amount of magnetization for the porous magnetic core particle and bring its pore diameter into a suitable range, the unevenness of the surface of the porous magnetic core particle is preferably subjected to a suitable degree of control. Moreover, facile control of the rate of the ferritization reaction is preferred, as is facile control of the resistivity and magnetic force of the porous magnetic core. Viewed in these terms, the Mn-containing Mn-type ferrites, Mn—Mg system ferrites, Mn—Mg—Sr system ferrites, and Li—Mn system ferrites are more preferred among the ferrites.

The production process is described in detail in the following for the case of the use of a ferrite as the porous magnetic carrier particle.

<Step 1 (Weighing•Mixing Step)>

The starting materials for the ferrite are weighed out and mixed.

The starting materials for the ferrite can be exemplified by metal particles of the metal elements specified above and their oxides, hydroxides, oxalates, and carbonates.

The mixing apparatus can be exemplified by the ball mill, planetary mill, Giotto mill, and vibrating mill. The ball mill is preferred thereamong for its mixing performance.

For example, the weighed-out starting materials for the ferrite and the balls may be introduced into a ball mill and pulverization and mixing may then be carried out for a period from 0.1 hours to 20.0 hours.

<Step 2 (Pre-Firing Step)>

A pre-fired ferrite is obtained by carrying out ferritization by pre-firing the pulverized and mixed ferrite starting materials for a period from 0.5 hours to 5.0 hours at a firing temperature in the range from 700° C. to 1200° C. in the air or under a nitrogen atmosphere. A firing furnace such as a burner-type firing furnace, a rotary firing furnace, or an electric furnace may be used for firing.

<Step 3 (Pulverization Step)>

The pre-fired ferrite obtained in step 2 is pulverized with a pulverizer.

The pulverizer can be exemplified by a crusher, hammer mill, ball mill, bead mill, planetary mill, and Giotto mill.

When, for example, a ball mill or bead mill is used, control of the material and diameter of the balls or beads used and the pulverization time is preferably carried out in order to bring the pulverized ferrite product to the desired particle diameter. In specific terms, balls with a high specific gravity and/or a long pulverization time may be used to obtain a small particle diameter for the pre-fired ferrite slurry. In addition, a broad particle size distribution may be obtained for the pre-fired ferrite by using balls or beads with a high specific gravity and using a short pulverization time. A pre-fired ferrite having a broad particle size distribution can also be obtained by mixing a plurality of pre-fired ferrites that have different particle diameters.

When a ball mill or bead mill is used, a wet method is preferred over a dry method because the former provides a higher pulverization efficiency because the pulverized product does not fly up within the mill.

<Step 4 (Granulation Step)>

Water, a binder, and optionally a pore modifier are added to the pulverized pre-fired ferrite product. The pore modifier can be exemplified by blowing agents and resin fine particles.

The blowing agent can be exemplified by sodium bicarbonate, potassium bicarbonate, lithium bicarbonate, ammonium bicarbonate, sodium carbonate, potassium carbonate, lithium carbonate, and ammonium carbonate.

The resin fine particles can be exemplified by fine particles of, for example, polyester; polystyrene; styrene copolymer such as styrene-vinyltoluene copolymer, styrene-vinylnaphthalene copolymer, styrene-acrylate ester copolymer, styrene-methacrylate ester copolymer, styrene-methyl α-chloromethacrylate copolymer, styrene-acrylonitrile copolymer, styrene-vinyl methyl ketone copolymer, styrene-butadiene copolymer, styrene-isoprene copolymer, and styrene-acrylonitrile-indene copolymer; polyvinyl chloride; phenolic resin; modified phenolic resin; maleic resin; acrylic resin; methacrylic resin; polyvinyl acetate; silicone resin; polyester resin having as its structural units monomer selected from aliphatic polyhydric alcohols, aliphatic dicarboxylic acids, aromatic dicarboxylic acids, aromatic dialcohols, and diphenols; polyurethane; polyamide; polyvinyl butyral; terpene resin; coumarone-indene resin; petroleum resin; and hybrid resin having a polyester unit and a vinyl polymer unit.

The binder can be exemplified by polyvinyl alcohol.

When pulverization is carried out by a wet method in step 3, the binder and optional pore modifier are preferably added considering the water that is also present in the ferrite slurry.

A granulate is obtained by drying and granulating the obtained ferrite slurry using a spray-drying apparatus in a heated atmosphere from 100° C. to 200° C. The spray-drying apparatus can be exemplified by a spray dryer.

<Step 5 (Main Firing Step)>

The granulate is fired for a time of from 1 hour to 24 hours in a temperature range from 800° C. to 1400° C.

Firing of the porous magnetic pore particle is advanced by raising the firing temperature and lengthening the firing time, which results in smaller pore diameters and fewer pores.

<Step 6 (Classification Step)>

The particles obtained by the above-described firing are crushed, and the coarse particles and fine particles may then be optionally removed by classification or sieving with a sieve.

The volume distribution-based 50% particle diameter (D50) of the magnetic core particles is preferably from 18.0 μm to 68.0 μm viewed from the perspective of inhibiting carrier adhesion to the image and inhibiting roughness by the image.

<Step 7 (Filling Step)>

The physical strength of the porous magnetic core particle is reduced as a function of the pore volume in the interior. Viewed from the perspective of raising the physical strength for the role of magnetic carrier, the resin is preferably filled into at least a portion of the voids in the porous magnetic core particle. The amount of resin filled into the porous magnetic core particle is preferably from 2 mass % to 15 mass % with reference to the porous magnetic core particle. The resin may be filled only into a portion of the voids; the resin may be filled only into the voids in the vicinity of the surface of the porous magnetic core particle with the spaces in the interior remaining present; or the voids may be entirely filled with the resin. However, there is preferably little variation in the resin content among the magnetic carrier population.

The method for filling the resin into the voids in the porous magnetic core particle can be exemplified by methods in which the porous magnetic core particle is impregnated with a resin solution by a coating method such as an immersion method, spray method, brush coating, or fluidized bed, followed by evaporation of the solvent.

Another example of a method for filling the resin into the voids in the porous magnetic core particle is a method in which the resin is diluted in a solvent and this is added into the voids in the porous magnetic core particle. The solvent used here should be able to dissolve the resin. Considering the case of resins capable of dissolving in organic solvents, the organic solvents can be exemplified by toluene, xylene, cellosolve butyl acetate, methyl ethyl ketone, methyl isobutyl ketone, and methanol. Water can be used as the solvent when a water-soluble resin or an emulsion-type resin is used.

The amount of the resin solid fraction in this resin solution is preferably from 1 mass % to 50 mass % and is more preferably from 1 mass % to 30 mass %. When the amount of the resin solid fraction is not more than 50 mass %, the viscosity of the resin solution will then not be too high, which facilitates a uniform permeation of the resin solution into the voids of the porous magnetic core particle. When the amount of the resin solid fraction is at least 1 mass %, this suppresses reductions in the attachment force by the resin to the porous magnetic core particle that would be brought about by a small amount of resin.

The resin used to fill the voids in the porous magnetic core particle can be, for example, a thermoplastic resin or a thermosetting resin. The resin used to fill the voids preferably has a high affinity for the porous magnetic core particle: when a resin with a high affinity is used, the surface of the porous magnetic core particle can also be coated with the resin at the same time the resin is being filled into the voids in the porous magnetic core particle.

In the case of thermoplastic resins, the filling resin can be exemplified by novolac resins, saturated alkylpolyester resins, polyarylates, polyamide resins, and acrylic resins. In the case of thermosetting resins, it can be exemplified by phenolic resins, epoxy resins, unsaturated polyester resins, and silicone resins.

The magnetic carrier of the present invention is obtained by coating the surface of the magnetic carrier core with a resin to form a resin coat layer.

The method for coating the surface of the magnetic carrier core with resin can be exemplified by methods in which coating is preformed by a coating method such as an immersion method, spray method, brush coating method, dry method, or fluidized bed. Immersion methods are preferred thereamong because they make it possible to bring about a suitable exposure of the magnetic carrier core at the surface.

Viewed from the perspective of bringing about a suitable exposure of the metal oxide portion of the magnetic carrier core at the surface, the amount of resin that is coated is preferably from 0.1 mass parts to 5.0 mass parts per 100 mass parts of the magnetic carrier core.

The structure of the toner is described in detail in the following.

The binder resin used in the toner is, for example, a vinyl resin, polyester resin, epoxy resin, and so forth. Vinyl resins and polyester resins are preferred among the preceding from the standpoints of the charging performance and fixing performance. Polyester resins are even more preferred.

The following resins may be used on an optional basis in the present invention mixed in the binder resin: homopolymers and copolymers of vinyl monomers, polyesters, polyurethanes, epoxy resins, polyvinyl butyrals, rosins, modified rosins, terpene resins, phenolic resins, aliphatic hydrocarbon resins, alicyclic hydrocarbon resins, and aromatic petroleum resins.

When a mixture of two or more resins is used as the binder resin, preferably resins having different molecular weights are mixed in suitable proportions.

The glass transition temperature of the binder resin is preferably from 45° C. to 80° C. The number-average molecular weight (Mn) of the binder resin is preferably from 2,500 to 50,000. The weight-average molecular weight (Mw) of the binder resin is preferably from 10,000 to 1,000,000.

From 45 mol % to 55 mol % of the total components in the polyester resin is preferably the alcohol component and from 45 mol % to 55 mol % is preferably the acid component.

The acid value of the polyester resin is preferably not more than 90 mg KOH/g and is more preferably not more than 50 mg KOH/g. The hydroxyl value of the polyester resin is preferably not more than 50 mg KOH/g and is more preferably not more than 30 mg KOH/g. The reason for this is as follows: the acid value and/or hydroxyl value of the polyester resin increases when the number of molecular chain terminal groups increases, while the environmental dependence of the charging characteristics of the toner grows larger when the number of molecular chain terminal groups increases.

The glass transition temperature of the polyester resin is preferably from 45° C. to 75° C. The number-average molecular weight (Mn) of the polyester resin is preferably from 1,500 to 50,000 and is more preferably from 2,000 to 20,000. The weight-average molecular weight (Mw) of the polyester resin is preferably from 6,000 to 100,000 and is more preferably from 10,000 to 90,000.

When a magnetic toner is used as the toner in the present invention, the magnetic material present in the magnetic toner can be exemplified by iron oxides such as magnetite, maghemite, and ferrite and iron oxides that contain other metal oxides; metals such as Fe, Co, and Ni and alloys of these metals with metals such as Al, Co, Cu, Pb, Mg, Ni, Sn, Zn, Sb, Be, Bi, Cd, Ca, Mn, Se, Ti, W, and V; and mixtures of the preceding.

The magnetic material can be more specifically exemplified by iron(II,III) oxide ($Fe_3O_4$), ferric oxide ($\gamma$-$Fe_2O_3$), iron zinc oxide ($ZnFe_2O_4$), iron yttrium oxide ($Y_3Fe_5O_{12}$), iron cadmium oxide ($CdFe_2O_4$), iron gadolinium oxide ($Gd_3Fe_5O_{12}$), iron copper oxide ($CuFe_2O_4$), iron lead oxide ($PbFe_{12}O_{19}$), iron nickel oxide ($NiFe_2O_4$), iron neodymium oxide ($NdFe_2O_3$), iron barium oxide ($BaFe_{12}O_{19}$), iron magnesium oxide ($MgFe_2O_4$), iron manganese oxide ($MnFe_2O_4$), iron lanthanum oxide ($LaFeO_3$), iron powder (Fe), cobalt powder (Co), and nickel powder (Ni).

The magnetic material, considered with respect to 100 mass parts of the binder resin in the toner particle, is preferably from 20 mass parts to 150 mass parts, more preferably from 50 mass parts to 130 mass parts, and even more preferably from 60 mass parts to 120 mass parts.

The nonmagnetic colorant used in the toner is exemplified by the following.

The black colorant can be exemplified by carbon black and by colorants that have been adjusted to black using a yellow colorant, a magenta colorant, and a cyan colorant.

The colored pigments used for the magenta toner can be exemplified by condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples are as follows: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, and 269; C. I. Pigment Violet 19; and C. I. Vat Red 1, 2, 10, 13, 15, 23, 29, and 35.

A pigment alone may be used for the colorant; however, in order to improve the sharpness and raise the quality of the full-color image, a dye and a pigment may be used in combination.

The dyes used for the magenta toner can be exemplified by oil-soluble dyes such as C. I. Solvent Red 1, 3, 8, 23, 24, 25, 27, 30, 49, 81, 82, 83, 84, 100, 109, and 121, C. I. Disperse Red 9, C. I. Solvent Violet 8, 13, 14, 21, and 27, and C. I. Disperse Violet 1, and by basic dyes such as C. I. Basic Red 1, 2, 9, 12, 13, 14, 15, 17, 18, 22, 23, 24, 27, 29, 32, 34, 35, 36, 37, 38, 39, and 40 and C. I. Basic Violet 1, 3, 7, 10, 14, 15, 21, 25, 26, 27, and 28.

The colored pigments used for the cyan toner can be exemplified by C. I. Pigment Blue 1, 2, 3, 7, 15:2, 15:3, 15:4, 16, 17, 60, 62, and 66; C. I. Vat Blue 6; C. I. Acid Blue 45; and copper phthalocyanine pigments in which 1 to 5 phthalimidomethyl groups are substituted on the phthalocyanine skeleton.

The colored pigments for yellow can be exemplified by condensed azo compounds, isoindolinone compounds, anthraquinone compounds, azo metal compounds, methine compounds, and allylamide compounds. Specific examples are as follows: C. I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191, and C. I. Vat Yellow 1, 3, and 20. Additional examples are dyes such as C. I. Direct Green 6, C. I. Basic Green 4, C. I. Basic Green 6, and Solvent Yellow 162.

The amount of use for the colorant, expressed with respect to 100 mass parts of the binder resin, is preferably from 0.1 mass parts to 30 mass parts and is more preferably from 0.5 mass parts to 20 mass parts and even more preferably from 3 mass parts to 15 mass parts.

A masterbatch (colorant masterbatch) made by mixing the colorant in advance with the binder resin is preferably used in toner production. A thorough dispersion of the colorant in the toner particle can be brought about by melt-kneading this colorant masterbatch with the other starting materials (e.g., binder resin, wax, and so forth).

The toner may use a charge control agent in order to stabilize the charging performance. The charge control agent is preferably used in the toner particle in an amount from 0.5 mass parts to 10 mass parts per 100 mass parts of the binder resin. Favorable charging characteristics are readily obtained at 0.5 mass parts and above, while at 10 mass parts and below, adverse effects on the compatibility with the other materials can be suppressed and overcharging at low humidities can be inhibited.

The charge control agent can be exemplified by the following.

Negative charge control agents, which control the toner to negative chargeability, can be exemplified by organometal complexes and chelate compounds. Specific examples are monoazo metal complexes, metal complexes of aromatic hydroxycarboxylic acids, and metal complexes of aromatic dicarboxylic acids. Other negative charge control agents are, for example, aromatic hydroxycarboxylic acids and aromatic mono- and polycarboxylic acids and their metal salts, anhydrides, and esters, and also phenol derivatives of bisphenols.

Positive charge control agents, which control the toner to positive chargeability, can be exemplified by nigrosine and its modifications by, for example, fatty acid metal salts; quaternary ammonium salts such as tributylbenzylammonium 1-hydroxy-4-naphth sulfonic acid salt and tetrabutylammonium tetrafluoroborate; onium salts that are analogues of the preceding, e.g., phosphonium salts, and, as their chelate pigments, triphenylmethane dyes and their lake pigments (the laking agent can be, for example, phosphotungstic acid, phosphomolybdic acid, phosphotungstomolybdic acid, tannic acid, lauric acid, gallic acid, ferricyanic acid, and ferrocyanides); and, as metal salts of higher fatty acids, diorganotin oxides such as dibutyltin oxide, dioctyltin oxide, and dicyclohexyltin oxide and diorganotin borates such as dibutyltin borate, dioctyltin borate, and dicyclohexyltin borate.

The toner particle may optionally contain one or more release agents. The release agent can be exemplified by aliphatic hydrocarbon waxes such as low molecular weight polyethylenes, low molecular weight polypropylenes, microcrystalline waxes, and paraffin waxes. Other examples are the oxides of aliphatic hydrocarbon waxes, e.g., oxidized polyethylene waxes, and their block copolymers; waxes in which the main component is a fatty acid ester, such as carnauba wax, sasol wax, and montanic acid ester wax; and partially or fully deacidified fatty acid esters, e.g., deacidified carnauba wax.

The amount of release agent in the toner particle, expressed per 100 mass parts of the binder resin, is preferably from 0.1 mass parts to 20 mass parts and is more preferably from 0.5 mass parts to 10 mass parts.

The melting point of the release agent, defined as the temperature of the highest endothermic peak during temperature ramp up in measurement by differential scanning calorimetry (DSC), is preferably from 65° C. to 130° C. and is more preferably from 80° C. to 125° C. When the melting point is at least 65° C., this suppresses a reduction in the viscosity of the toner and inhibits the occurrence of adhesion by the toner to the photosensitive member. An excellent low-temperature fixability is obtained when the melting point is not more than 130° C.

Fine particles, that through external addition to the toner particle can increase the flowability over that prior to addition, may be used with the toner as a flowability improver. Examples of the flowability improver are fluororesin particles such as vinylidene fluoride fine particles and polytetrafluoroethylene fine particles and flowability improvers having a hydrophobicity value in the range from 30 to 80 according to measurement by the methanol titration test and provided by the execution of a surface treatment (hydrophobic treatment) with a silane coupling agent, titanium coupling agent, or silicone oil on a finely particulate silica, e.g., a silica produced a wet method or a silica produced by a dry method, a finely particulate titanium oxide, a finely particulate alumina, and so forth.

The flowability improver is preferably used, expressed per 100 mass parts of the toner particle, at from 0.1 mass parts to 10 mass parts and more preferably at from 0.2 mass parts to 8 mass parts.

When the toner is mixed with the magnetic carrier of the present invention and used as a two-component developer, the concentration of the toner in the two-component developer is preferably from 2 mass % to 15 mass % and more preferably from 4 mass % to 13 mass %. Reductions in the image density are suppressed when the toner concentration is at least 2 mass %, while the occurrence of scattering within the apparatus and fogging is suppressed when the toner concentration is not more than 15 mass %.

In addition, for the replenishing developer, which is used to replenish the developing device in response to the decline in the toner concentration in the two-component developer within the developing device, the amount of toner is preferably from 2 mass parts to 50 mass parts per 1 mass parts of the replenishing magnetic carrier.

A detailed description follows of an example of an image-forming apparatus that is provided with a developing assembly that uses the magnetic carrier of the present invention and that uses a two-component developer and a replenishing developer that contain this magnetic carrier; however, image-forming apparatuses that use the magnetic carrier of the present invention are not limited to this.

<The Image-Forming Apparatus•Image-Forming Method>

Referring to FIG. 1, an electrostatic latent image bearing member (the photosensitive member) 1 rotates in the direction indicated by the arrow in FIG. 1. The surface of the electrostatic latent image bearing member 1 is charged (primary charging) by a charging device 2, which is a charging means. The surface of the charged electrostatic latent image bearing member 1 is then irradiated with exposure light by an exposure device 3, which is an exposure means (latent electrostatic image-forming means), and an electrostatic latent image is thereby formed on the surface of the electrostatic latent image bearing member 1.

A developing device 4, which is a developing means, has a developer container 5 holding a two-component developer, and is disposed in a state that enables a developer bearing member 6 to rotate. A magnet 7 is housed as a magnetic field-generating means in the interior of the developer bearing member 6. At least one magnet 7 is disposed in a position facing the electrostatic latent image bearing member 1.

The two-component developer is held on the developer bearing member 6 by the magnetic field of the magnet 7; the amount of the two-component developer is controlled by the control member 8; and the two-component developer is transported to the developing zone, which resides opposite from the electrostatic latent image bearing member 1. A magnetic brush is formed in the developing zone by the magnetic field generated by the magnet 7. The electrostatic latent image is then visualized as a toner image by the application of a developing bias, which is provided by superimposing an alternating electrical field on a direct current electrical field.

The toner image formed on the surface of the electrostatic latent image bearing member 1 is electrostatically transferred to a transfer material (recording medium) 12 by a transfer charging device 11, which is a transfer means.

Figure 2:
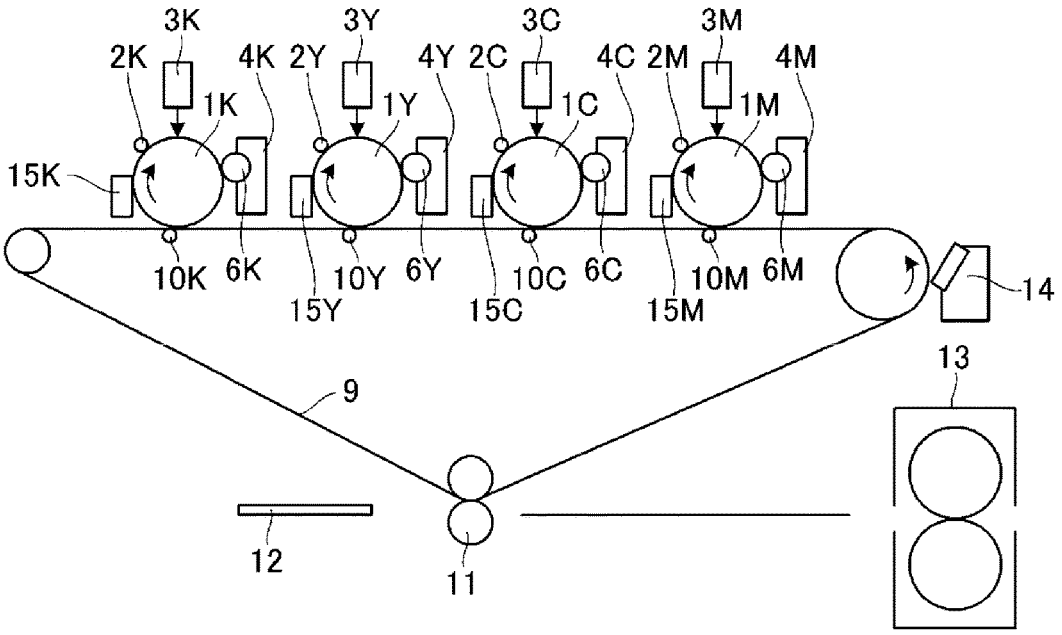
FIG. 2 is a schematic diagram of an image-forming apparatus that can use the magnetic carrier of the present invention.

Here, as shown in FIG. 2, a primary transfer may be carried out of the toner image to the surface of an intermediate transfer member 9 from the electrostatic latent image bearing member 1 by a primary transfer charging device, after which a secondary transfer of the toner image to the transfer material 12 may be carried out electrostatically by a secondary transfer charging device.

The transfer material 12 is then transported to a fixing unit 13, which is a fixing means, and here the toner image is fixed on the transfer material 12 by the application of heat and pressure. This is followed by discharge of the transfer material 12 from the image-forming apparatus as the output image.

A cleaner 15, which is a cleaning means, removes the toner (untransferred toner) that remains on the surface of the electrostatic latent image bearing member 1 after the toner image has been transferred to the transfer material 12 or the intermediate transfer member 9. After this, the electrostatic latent image bearing member 1, now having a surface cleaned by the cleaner 15, is electrically initialized by irradiation with preexposure light from a preexposure lamp 16. The image-forming process described in the preceding is then repeated.

An example of a full-color image-forming apparatus is shown in FIG. 2.

There is no limitation to the sequence of the image-forming units, e.g., K, Y, C, and M, shown in FIG. 2, nor is there a limitation to the arrows showing the direction of rotation. Here, K denotes black, Y denotes yellow, C denotes cyan, and M denotes magenta.

The electrostatic latent image bearing members (photosensitive members) 1K, 1Y, 1C, and 1M in FIG. 2 rotate in the direction of the arrows in FIG. 2. The surface of each electrostatic latent image bearing member is charged (primary charging) by a charging device 2K, 2Y, 2C, 2M, which is a charging means. The surface of each charged electrostatic latent image bearing member is then irradiated with exposure light by an exposure device 3K, 3Y, 3C, 3M, which is an exposure means, and an electrostatic latent image is thereby formed on the surface of the particular electrostatic latent image bearing member.

The electrostatic latent image on the surface of the particular electrostatic latent image bearing member is subsequently visualized as a toner image by the two-component developer carried on a developer bearing member 6K, 6Y, 6C, 6M rotatably disposed in a developing device 4K, 4Y, 4C, 4M, which is a developing means.

The toner image on the surface of each electrostatic latent image bearing member subsequently undergoes primary transfer by a primary transfer charging device 10K, 10Y, 10C, 10M to the surface of the intermediate transfer member 9. The toner image is further transferred to the transfer material 12 by the secondary transfer charging device 11.

The transfer material 12 is then transported to a fixing unit 13, which is a fixing means, and here the toner image is fixed on the transfer material 12 by the application of heat and pressure. This is followed by discharge of the transfer material 12 from the image-forming apparatus as the output image.

An intermediate transfer member cleaner 14, which is a cleaning means for the intermediate transfer member 9, removes the toner (untransferred toner) that remains on the surface of the intermediate transfer member 9 after the toner image has been transferred to the transfer material 12.

In a preferred development method, development is carried out specifically in a configuration in which the magnetic brush is in contact with the electrostatic latent image bearing member (photosensitive member) while an alternating electric field is being formed in the developing zone by the application of an alternating current voltage to the developer bearing member. Viewed from the perspective of inhibiting carrier adhesion and improving the dot reproducibility, the gap (the S-D gap) between the developer bearing member (for example, a developing sleeve) 6 and the electrostatic latent image bearing member (for example, a photosensitive drum) is preferably from 100 μm to 1000 μm. At equal to or greater than 100 μm, inadequate feed of the developer is suppressed and reductions in image density are suppressed. At equal to or less than 1000 μm, broadening of the magnetic lines of force from a magnetic pole S1 is suppressed; reductions in the density of the magnetic brush are inhibited; reductions in the dot reproducibility are suppressed; weakening of the forces that restrain the magnetic coated carrier is inhibited; and the appearance of carrier adhesion is inhibited.

The peak-to-peak voltage (Vpp) of the alternating electric field is preferably from 300 V to 3,000 V and is more preferably from 500 V to 1,800 V.

The frequency of the alternating electric field is preferably from 500 Hz to 10,000 Hz and is more preferably from 1,000 Hz to 7,000 Hz.

The waveform of the alternating current bias for forming the alternating electric field can be, for example, a triangular wave, a rectangular wave, or a sine wave, and the waveform may have a variable duty ratio.

In order to accommodate variations in the toner image formation rate, development is preferably carried out by applying, to the developer bearing member, a developing bias voltage that has a non-continuous alternating current bias voltage (intermittent alternating superimposed voltage). A satisfactory image density is readily obtained and the toner in nonimage areas (fogging toner) is easily recovered when the applied voltage is at least 300 V. At 3,000 V and below, the production of perturbations of the electrostatic latent image via the magnetic brush is suppressed and reductions in image quality by perturbations in the electrostatic latent image are then suppressed.

By using a two-component developer having a well-charged toner, the defogging voltage (Vback) can be reduced and the voltage for primary charging of the electrostatic latent image bearing member (photosensitive member) can be reduced, and the life of the electrostatic latent image bearing member can be lengthened as a result. The defogging voltage (Vback) is preferably not more than 200 V and is more preferably not more than 150 V. Viewed from the perspective of producing a satisfactory image density, the contrast potential is preferably from 100 V to 400 V.

With regard to the structure of the electrostatic latent image bearing member (photosensitive member), an example is a structure in which, for example, a conductive layer, an undercoat layer, a charge generation layer, and a charge transport layer are formed in this sequence on a conductive substrate, e.g., aluminum, stainless steel (SUS), and so forth. As necessary, a protective layer and/or a charge injection layer may be disposed on the charge transport layer.

<Method for Measuring the Acid Value>

In the present invention, the acid value is the mass [mg] of potassium hydroxide required to neutralize the acid present in 1 g of a sample. Thus, the acid value is the mass [mg] of potassium hydroxide required to neutralize, for example, the free fatty acid and the resin acid, present in 1 g of sample.

The acid value was measured in the present invention in accordance with JIS K 0070-1992. In specific terms it was measured according to the following procedure.

(1) Reagent Preparation

A phenolphthalein solution was obtained by dissolving 1.0 g of phenolphthalein in 90 mL of ethyl alcohol (95 volume %) and bringing to 100 mL by adding deionized water.

7 g of special-grade potassium hydroxide was dissolved in 5 mL of water and this was brought to 1 L by the addition of ethyl alcohol (95 volume %). This was introduced into an alkali-resistant container avoiding contact with, for example, carbon dioxide, and allowed to stand for 3 days. Standing was followed by filtration to obtain a potassium hydroxide solution. The obtained potassium hydroxide solution was stored in an alkali-resistant container. The factor for this potassium hydroxide solution was determined from the amount of the potassium hydroxide solution required for neutralization when 25 mL of 0.1 mol/L hydrochloric acid was introduced into an Erlenmeyer flask, several drops of the aforementioned phenolphthalein solution was added, and titration was performed using the potassium hydroxide solution. The 0.1 mol/L hydrochloric acid was prepared in accordance with JIS K 8001-1998.

(2) Procedure (A) Main Test 2.0 g of the sample was accurately weighed into a 200-mL Erlenmeyer flask and 100 mL of a toluene/ethanol (2:1) mixed solution was added and dissolution of the sample was carried out over 5 hours. Several drops of the aforementioned phenolphthalein solution were added as an indicator and titration was performed using the aforementioned potassium hydroxide solution. The titration endpoint was taken to be persistence of the faint pink color of the indicator for 30 seconds.

(B) Blank Test

The same titration as in the above procedure was run, but without adding the sample (that is, with only the toluene/ethanol (2:1) mixed solution).

(3) Calculation of the Acid Value

The obtained results were substituted into the following formula to calculate the acid value.

$$AV=[(B-A)\times f\times 5.61]/S$$

In this formula, AV represents the acid value [mg KOH/g]; A represents the amount [mL] of addition of the potassium hydroxide solution in the blank test; B represents the amount [mL] of addition of the potassium hydroxide solution in the main test; f represents the factor for the potassium hydroxide solution; and S represents the mass [g] of the sample.

<Method for Measuring the Volume-Average Particle Diameter (D50) of the Magnetic Carrier and the Porous Magnetic Core>

The particle size distribution was measured in the present invention using a laser diffraction•scattering particle size distribution analyzer (product name: Microtrac MT3300EX, from Nikkiso Co., Ltd.).

The measurement of the volume-average particle diameter (D50) of the magnetic carrier and porous magnetic core particle was carried out with a sample feeder for dry measurement (product name: Turbotrac one-shot dry sample conditioner, from Nikkiso Co., Ltd.) installed. Using a dust collector as the vacuum source, the Turbotrac feed conditions were an air current of 33 L/second and a pressure of 17 kPa. Control was carried out automatically by software. The 50% particle diameter (D50), which is the cumulative value of the volume average, was determined for the particle diameter. Control and analysis was carried out using the provided software (version 10.3.3-202D). The measurement conditions are given below.

Set Zero time: 10 seconds
measurement time: 10 seconds
number of measurements: 1
particle refractive index: 1.81%
particle shape: nonspherical
measurement upper limit: 1408 μm
measurement lower limit: 0.243 μm
measurement environment: temperature 23° C./humidity 50% RH <Method of Measuring the Weight-Average Particle Diameter (D4) and the Number-Average Particle Diameter (D1) of the Toner>

The weight-average particle diameter (D4) and the number-average particle diameter (D1) of the toner were measured using a precision particle size distribution measurement instrument operating on the pore electrical resistance method and equipped with a 100 μm aperture tube (product name: Coulter Counter Multisizer 3, Beckman Coulter, Inc.). The measurement conditions were set and the measurement data were analyzed using the dedicated software (product name: Beckman Coulter Multisizer 3 Version 3.51, Beckman Coulter, Inc.) provided with this precision particle size distribution measurement instrument. The determinations were made by measurement in 25,000 channels for the number of effective measurement channels and analysis of the measurement data.

The aqueous electrolyte solution used for the measurements was prepared by dissolving special-grade sodium chloride in deionized water to provide a concentration of 1 mass %, and specifically "ISOTON II" (product name) from Beckman Coulter, Inc. was used.

The dedicated software was configured as follows prior to measurement and analysis.

In the "modify the standard operating method (SOM)" screen in the dedicated software, the total count number in the control mode was set to 50,000 particles and the number of measurements was set to 1 time. In addition, the Kd value was set to the value obtained using 10.0 μm standard particles from Beckman Coulter, Inc. The threshold value and noise level were automatically set by pressing the threshold value/noise level measurement button. The current was set to 1600 μA; the gain was set to 2; the electrolyte was set to ISOTON II (product name); and a check was entered for the post-measurement aperture tube flush.

In the "setting conversion from pulses to particle diameter" screen of the dedicated software, the bin interval was set to logarithmic particle diameter; the particle diameter bin was set to 256 particle diameter bins; and the particle diameter range was set to 2 μm to 60 μm.

The specific measurement procedure is as follows.

(1) 200 mL of the above-described aqueous electrolyte solution was introduced into a 250-mL roundbottom glass beaker intended for use with the Multisizer 3 and this was placed in the sample stand and counterclockwise stirring with the stirrer rod was carried out at 24 rotations per second. Contamination and air bubbles within the aperture tube were removed by the "aperture flush" function of the dedicated software.

(2) 30 mL of the above-described aqueous electrolyte solution was introduced into a 100-mL flatbottom glass beaker. To this was added, as a dispersing agent, 0.3 mL of a dilution prepared by the three-fold (mass) dilution with deionized water of Contaminon N (product name) from Wako Pure Chemical Industries, Ltd. Contaminon N (product name) is a 10 mass % aqueous solution of a neutral pH 7 detergent for cleaning precision measurement instrumentation and contains a nonionic surfactant, anionic surfactant, and organic builder.

(3) Deionized water was introduced in a prescribed amount into the water tank of an ultrasound disperser from Nikkaki Bios Co., Ltd. (product name: Ultrasonic Dispersion System Tetora 150). 2 mL of Contaminon N was added to this water tank. This ultrasound disperser has an electrical output of 120 W and is equipped with two oscillators having an oscillation frequency of 50 kHz and disposed such that the phases are displaced by 180°.

(4) The beaker in (2) was set into the beaker holder opening on the ultrasound disperser and the ultrasound disperser was started. The vertical position of the beaker was adjusted in such a manner that the resonance condition of the surface of the aqueous electrolyte solution within the beaker was at a maximum.

(5) While the aqueous electrolyte solution within the beaker of (4) was being irradiated with ultrasound, 10 mg of the toner was added to the aqueous electrolyte solution in small aliquots and dispersion was carried out. The ultrasound dispersion treatment was continued for an additional 60 seconds. The water temperature in the water tank was controlled as appropriate during ultrasound dispersion to be from 10° C. to 40° C.

(6) Using a pipette, the dispersed toner-containing aqueous electrolyte solution of (5) was dripped into the round-bottom beaker set in the sample stand as described in (1) with adjustment to provide a measurement concentration of 5%. Measurement was then performed until the number of measured particles reached 50,000.

(7) The measurement data was analyzed by the previously cited dedicated software provided with the precision particle size distribution measurement instrument and the weight-average particle diameter (D4) and the number-average particle diameter (D1) were calculated. When set to graph/volume % with the dedicated software, the "average diameter" on the analysis/volumetric statistical value (arithmetic average) screen is the weight-average particle diameter (D4). When set to graph/number % with the dedicated software, the "average diameter" on the analysis/numerical statistical value (arithmetic average) screen is the number-average particle diameter (D1).

<Measurement of the Minimum Value of the Storage Elastic Modulus (G') and the Minimum Value of the Loss Elastic Modulus (G") of the Resin Coat Layer at from 70° C. to 100° C.>

A rotating plate rheometer (product name: ARES, TA Instruments, Inc.) was used as the instrumentation for measuring the storage elastic modulus (G') and the loss elastic modulus (G"). The following were used as the measurement samples: a sample obtained by dissolving the coat resin A and the coat resin B in toluene and then removing the solvent, or the coat resin eluted from the magnetic carrier using toluene.

The sample provided by compression molding into a circular disk with a diameter of 7.9 mm and a thickness of 2.0±0.3 (mm) using a tablet molder in an environment with a temperature of 25° C. was used as the measurement sample. This sample was placed in the parallel plates; the temperature was raised from room temperature (25° C.) to 180° C. in 20 minutes; the shape of the sample was trimmed; cooling was carried out to 25° C., which was the start temperature for the measurement of the viscoelasticity; and the measurement was started. At this time, the sample is preferably set so the initial normal force is 0. In addition, as described below, the influence of the normal force can be cancelled by using automatic tension adjustment (Auto Tension Adjustment ON) in the ensuing measurement. The measurement was carried out under the following conditions.

(1) Parallel plates with a diameter of 7.9 mm were used.

(2) Frequency: 1.0 Hz (3) Initial value of applied strain (Strain): set to 0.1%.

(4) Measurement was carried out at a ramp rate of 2.0 [° C./minute] in the temperature range from 25° C. to 120° C. The measurement was run under the following setting conditions for the automatic adjustment mode. The measurement was run in automatic strain adjustment mode (Auto Strain).

(5) The maximum strain (Max Applied Strain) was set to 20.0%.

(6) The maximum torque (Max Allowed Torque) was set to 200.0 [g·cm] and the minimum torque (Min Allowed Torque) was set to 0.2 [g·cm].

(7) The strain adjustment was set to 20.0% of Current Strain. The automatic tension adjustment mode (Auto Tension) was used in the measurement.

(8) The automatic tension direction (Auto Tension Direction) was set to compression.

(9) The initial static force was set to 100 g and the automatic tension sensitivity (Auto Tension Sensitivity) was set to 40.0 g.

(10) The operating condition for automatic tension (Auto Tension) was made sample modulus: at least $1.0\times10^3$ Pa.

The results for the storage elastic modulus (G') and the loss elastic modulus (G") in the range from 70° C. to 100° C. were read out and the minimum value and its temperature were determined.

<Separation of the Resin Coat Layer from the Magnetic Carrier and Fractionation of the Coat Resin A and the Coat Resin B in the Resin Coat Layer>

The method for separating the resin coat layer from the magnetic carrier can be exemplified by a method in which the magnetic carrier is placed in a cup and the coat resin is eluted using toluene.

The eluted resin can be fractionated using the following instrumentation.

[Instrument Configuration]

LC-908 (Japan Analytical Industry Co., Ltd.)

JRS-86 (repeat injector, Japan Analytical Industry Co., Ltd.)

JAR-2 (autosampler, Japan Analytical Industry Co., Ltd.)

FC-201 (fraction collector, Gilson, Inc.)

[Column Configuration]

JAIGEL-1H to 5H (diameter 20 mm×600 mm: preparative columns, Japan Analytical Industry Co., Ltd.)

[Measurement Conditions]

temperature: 40° C.

solvent: tetrahydrofuran (THF)

flow rate: 5 mL/minute detector: RI

The elution times corresponding to the peak molecular weights (Mp) of the coat resin A and the coat resin B were measured in advance by the method given below, and the coat resin A component and the coat resin B component were each fractionated at before and after these, respectively. This was followed by removal of the solvent and drying to obtain the coat resin A and the coat resin B. With regard to the structure of the coat resins, the coat resin A and the coat resin B were identified by identifying the atomic groups from the absorption wavenumbers obtained using a Fourier-transform infrared spectrometer (product name: Spectrum One, PerkinElmer Inc.).

<Measurement of the Weight-Average Molecular Weight (Mw) and the Peak Molecular Weight (Mp) of the Coat Resin A and the Coat Resin B in the Resin Coat Layer and Measurement of the Ratio of their Contents>

The weight-average molecular weight (Mw) and the peak molecular weight (Mp) of the coat resin A and the coat resin B in the resin coat layer was measured according to the following procedure using gel permeation chromatography (GPC).

First, the measurement sample was prepared as follows.

The sample (coat resin A and coat resin B as fractionated from the coat resin separated from the magnetic carrier) and THF were mixed at a concentration of 5 mg/mL and this was allowed to stand for 24 hours at room temperature in order to dissolve the sample in the THF. The sample for GPC was subsequently prepared by passage through sample treatment filters (product name: Maishori Disku (sample pretreatment disk) H-25-2, from Tosoh Corporation, and product name: Ekicrodisk 25CR, from Gelman Science Japan, Ltd.).

Then, using a GPC measurement instrument (product name: HLC-8120GPC, Tosoh Corporation), measurement was carried out in accordance with the operating manual for this GPC measurement instrument under the following measurement conditions.

[Measurement Conditions]

instrument: high-performance GPC (product name: HLC8120 GPC, from Tosoh Corporation)

columns: 7-column train of Shodex KF-801, 802, 803, 804, 805, 806, and 807 (from Showa Denko K.K.)

eluent: THF flow rate: 1.0 mL/minute oven temperature: 40.0° C.

sample injection amount: 0.10 mL

The calibration curve used to determine the weight-average molecular weight (Mw) and the peak molecular weight (Mp) of the sample was a molecular weight calibration curve that was constructed using polystyrene resin standards (product name: TSK Standard Polystyrene F-850, F-450, F-288, F-128, F-80, F-40, F-20, F-10, F-4, F-2, F-1, A-5000, A-2500, A-1000, and A-500 from the Tosoh Corporation).

Figure 3:
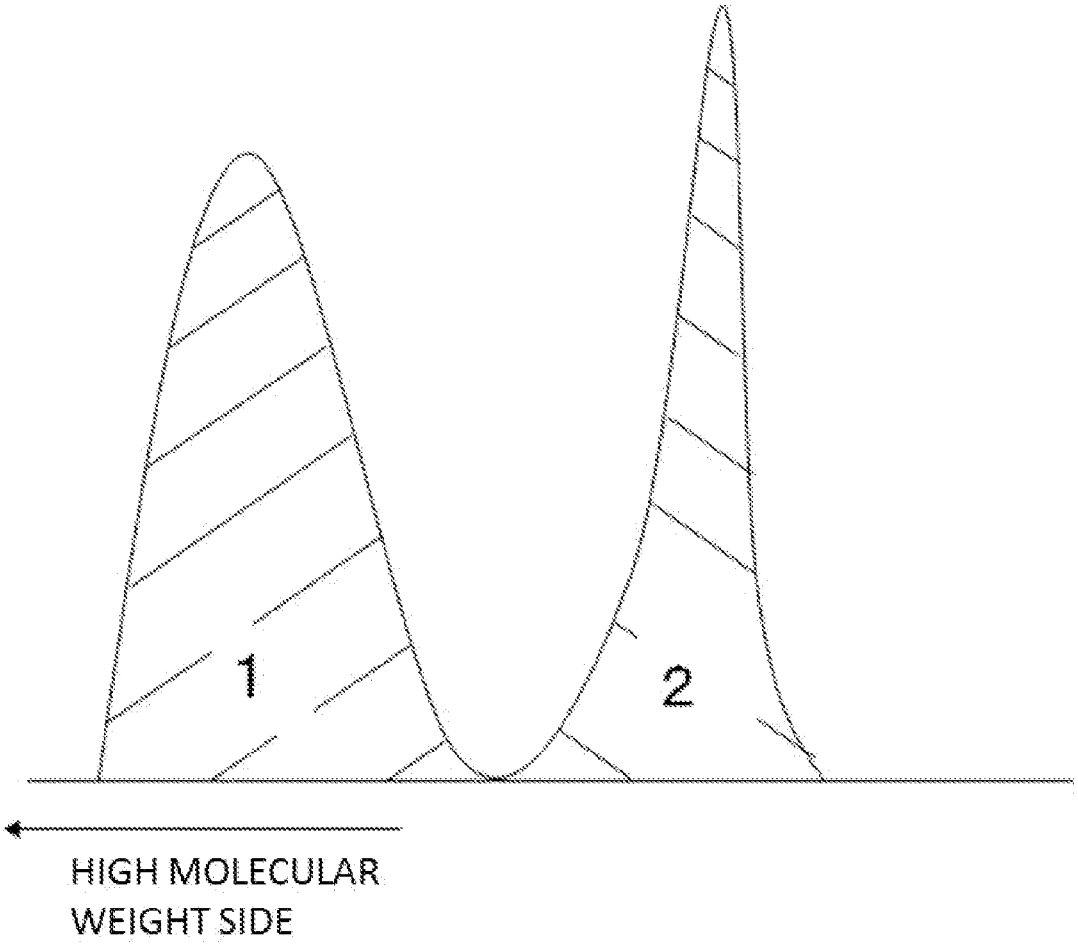
FIG. 3 is a schematic diagram of a method for defining the coat resin content according to a GPC molecular weight distribution curve.
Figure 4:
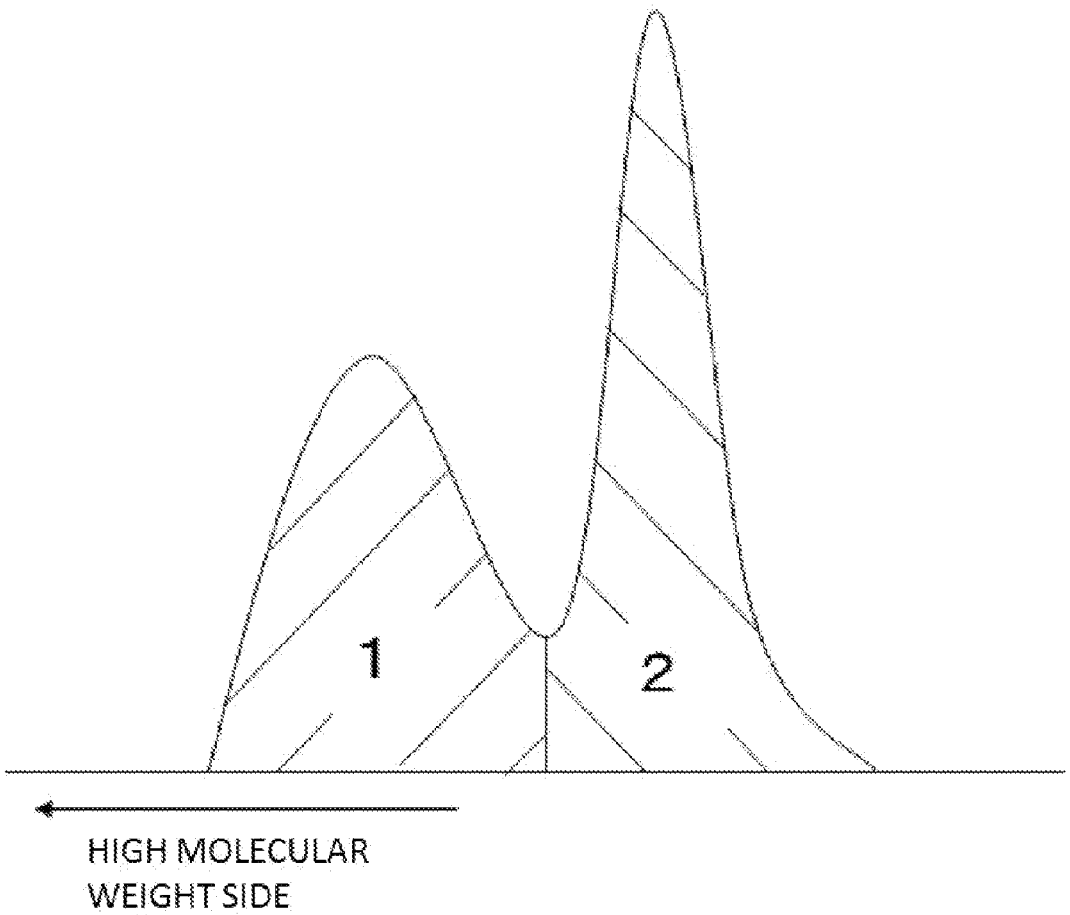
FIG. 4 is a schematic diagram of a method for defining the coat resin content according to a GPC molecular weight distribution curve.

The ratio of the contents of the coat resin A and the coat resin B was determined by the ratio of the peak areas in the molecular weight distribution measurement. As shown in FIG. 3, when the region 1 and the region 2 were completely divided, the ratio of the contents of the coat resin A and the coat resin B was determined from the area ratio of the individual regions. When these regions overlapped, as shown in FIG. 4, partitioning was carried out by a line drawn perpendicularly to the horizontal axis from the inflection point in the GPC molecular weight distribution curve and the ratio of the contents of the coat resin A and the coat resin B was determined from the area ratio of the region 1 and region 2 shown in FIG. 4.

EXAMPLES

The present invention is more specifically described with reference to the following examples, but the present invention is not limited only to these examples.

<Production Example for Magnetic Carrier Core 1>

Step 1 (Weighing•Mixing Step)

$Fe_2O_3$: 68.3 mass %

$MnCO_3$: 28.5 mass %

$Mg(OH)_2$: 2.0 mass %

$SrCO_3$: 1.2 mass %

The ferrite precursors were weighed out; 20 mass parts of water was added to 80 mass parts of the ferrite precursors; and pulverization was carried out to prepare a slurry. The solids concentration in the slurry was made 80 mass %.

Step 2 (Pre-Firing Step)

The slurry was dried using a spray dryer (Ohkawara Kakohki Co., Ltd.) followed by firing for 3.0 hours at a temperature of 1050° C. in a batch electric furnace under a nitrogen atmosphere (oxygen concentration: 1.0 volume %) to produce a pre-fired ferrite.

Step 3 (Pulverization Step)

The pre-fired ferrite was pulverized to about 0.5 mm with a crusher and water was then added to produce a slurry. The solids concentration in the slurry was brought to 70 mass %. This slurry was introduced into a wet-type ball mill that used ⅛-inch stainless steel beads and a grinding process was carried out for 3 hours to obtain a slurry. This slurry was introduced into a wet-type bead mill that used zirconia with a diameter of 1 mm and a grinding process was carried out for 4 hours to obtain a pre-fired ferrite slurry having a 50% particle diameter (D50) on a volume basis for the pre-fired ferrite contained therein of 1.3 μm.

Step 4 (Granulation Step)

1.0 mass parts of an ammonium polycarboxylate as a dispersing agent and 1.5 mass parts of polyvinyl alcohol as a binder were added to 100 mass parts of the aforementioned pre-fired ferrite slurry, followed by drying with a spray dryer (Ohkawara Kakohki Co., Ltd.) to granulate into spherical particles. Particle size adjustment was carried out on the obtained granulate, which was then heated for 2 hours at 700° C. using a rotary electric furnace to remove the organics, e.g., the dispersing agent, binder, and so forth.

Step 5 (Firing Step)

Firing was performed in a nitrogen atmosphere (oxygen concentration: 1.0 volume %) by going from room temperature (25° C.) to the firing temperature (1100° C.) in a time period of 2 hours and holding for 4 hours at a temperature of 1100° C. This was followed by cooling to a temperature of 60° C. over 8 hours; returning to the atmosphere from the nitrogen atmosphere; and removal at a temperature at or below 40° C.

Step 6 (Classification Step)

After the aggregated particles had been crushed, the coarse particles were removed by sieving on a sieve with an aperture of 150 μm; the fines were removed by air classification; and the weakly magnetic fraction was removed by magnetic separation to obtain a porous magnetic core. The obtained porous magnetic pore particle had voids in the form of pores.

Step 7 (Filling Step)

100 mass parts of the obtained porous magnetic core particles was introduced into the mixing vessel of a mixer/stirrer (product name: Versatile Mixer Model NDMV from the Dalton Co., Ltd.), and, while holding the temperature at 60° C., nitrogen was introduced while reducing the pressure to 2.3 kPa. 49.5 mass parts toluene and 0.5 mass parts γ-aminopropyltriethoxysilane were stirred for 10 minutes with a multiblender mixer with 50 mass parts silicone resin (product name: SR2410, from Dow Corning Toray Co., Ltd.) therein and the mixture was dripped onto the porous magnetic core particles. The dripped amount was adjusted to provide 4.0 mass parts as the resin component solids fraction per 100 mass parts of the porous magnetic core particles.

Stirring was continued in this state for 2.5 hours after the completion of the dropwise addition, and the temperature was then raised to 70° C. and the solvent was removed under reduced pressure to fill the resin component obtained from resin solution 1 into the particle interior of the porous magnetic core particle.

After cooling, the obtained resin-filled magnetic core particles were transferred into the container of a stirrer (mixer) equipped with a spiral paddle (product name: Drum Mixer Model UD-AT, from Sugiyama Heavy Industrial Co., Ltd.). This was followed by heating to 220° C., which was the set temperature for the stirrer, at a ramp rate of 2° C./minute under a nitrogen atmosphere. Stirring was carried out for 1.0 hour while heating at this temperature in order to cure the resin, and stirring while holding at 200° C. was continued for an additional 1.0 hour.

This was followed by cooling to room temperature (25° C.); removal of the cured resin-filled ferrite particles; and removal of the nonmagnetic material using a magnetic separator. The coarse particles were additionally removed using a vibrating sieve to obtain a resin-filled magnetic carrier core 1. Magnetic carrier core 1 had a 50% particle diameter on a volume basis (D50) of 38.5 μm.

<Production Example for Magnetic Carrier Core 2>

A silane coupling agent (3-(2-aminoethylamino)propyltrimethoxysilane) was added at 4.0 mass % to a magnetite powder having a number-average particle diameter of 0.30 μm and the finely divided particles were treated by high-speed mixing and stirring within a container at 100° C. or above.

phenol: 10 mass parts formaldehyde solution (40% formaldehyde, 10% methanol, and 50% water): 6 mass parts the treated magnetite: 84 mass parts These materials, 5 mass parts of 28% aqueous ammonia, and 20 mass parts of water were introduced into a flask; the temperature was raised to 85° C. in 30 minutes while stirring and mixing; and this was followed by holding and carrying out a polymerization reaction for 3 hours and curing the synthesized phenol resin. The cured phenol resin was subsequently cooled to 30° C.; more water was added and the supernatant was then removed; and the sediment was washed with water and then air-dried. This was followed by drying at a temperature of 60° C. under reduced pressure (5 mmHg or below) to obtain a spherical magnetic carrier core 2 in which a magnetic body is dispersed. Magnetic carrier core 2 had a 50% particle diameter on a volume basis (D50) of 38.5 μm.

<Production Examples for Magnetic Carriers 1 to 28>

The coat resin A and coat resin B given in Tables 1 and 2 were introduced in the ratio given in Table 3 into a planetary mixer (product name: Nauta Mixer Model VN, from Hosokawa Micron Corporation) being held at a temperature of 60° C. under reduced pressure (1.5 kPa); 900 mass parts of toluene was introduced per 100 mass parts of the resin component (coat resin A and coat resin B); and mixing was carried out until the resin was thoroughly dissolved to prepare a coat resin solution. The coat resin solution was introduced to the magnetic carrier core shown in Table 4 so as to provide the coat resin at 2.1 mass parts, as the resin component solids fraction, per 100 mass parts of the magnetic carrier core.

With regard to the method of introduction, one-third of the resin solution was first introduced and solvent removal and coating were carried out for 20 minutes. Then, another one-third of the resin solution was introduced and solvent removal and coating were carried out for 20 minutes, and another one-third of the resin solution was introduced and solvent removal and coating were carried out for 20 minutes.

The magnetic carrier coated by the coat resin composition was then transferred to the vessel of a stirrer (mixer) equipped with a spiral paddle within a rotatable mixing vessel (product name: Drum Mixer Model UD-AT, from Sugiyama Heavy Industrial Co., Ltd.). While stirring by rotating the vessel at 10 rotations per minute, a heat treatment was carried out for 2 hours at a temperature of 120° C. under a nitrogen atmosphere. The obtained magnetic carrier was subjected to fractionation of the weakly magnetic product by magnetic separation, passage through a sieve with an aperture of 150 μm, and then classification with an air classifier. A magnetic carrier 1 with a 50% particle diameter on a volume basis (D50) of 39.0 μm was obtained.

Magnetic carriers 2 to 28 were produced in the same manner as for the production of magnetic carrier 1, but changing the type of magnetic carrier core and the type and amount of the coat resin as shown in Table 4.

The properties values for the obtained magnetic carriers 1 to 28 are shown in Table 4.

TABLE 1

| | | | macromonomer | | | | | | G' from 70° C. to 100° C. | | G" from 70° C. to 100° C. | |
|---|---|---|---|---|---|---|---|---|---|---|---|---|
| | main chain monomer constituent monomer | amount of addition (mass %) | constituent monomer | Mw | amount of addition (mass %) | Mw | acid value | minimum value ($\times 10^8$ Pa) | temperature (° C.) | minimum value ($\times 10^7$ Pa) | temperature (° C.) |
| resin A-1 | cyclohexyl methacrylate<br>methyl methacrylate | 74.5<br>0.5 | methyl methacrylate | 5000 | 25.0 | 57,000 | 0.5 | 0.072 | 100 | 0.123 | 100 |
| resin A-2 | cyclohexyl methacrylate<br>methyl methacrylate | 79.5<br>0.5 | butyl methacrylate | 4000 | 20.0 | 58,000 | 0.8 | 0.006 | 100 | 0.009 | 100 |
| resin A-3 | cyclohexyl methacrylate<br>methacrylic acid | 79.8<br>0.2 | methyl methacrylate | 5000 | 20.0 | 60,000 | 1.0 | 0.063 | 100 | 0.096 | 100 |
| resin A-4 | cyclohexyl methacrylate<br>methacrylic acid | 79.7<br>0.3 | styrene | 5000 | 20.0 | 39,000 | 1.5 | 0.009 | 100 | 0.015 | 100 |
| resin A-5 | cyclohexyl methacrylate<br>methacrylic acid | 79.6<br>0.4 | acrylonitrile | 5000 | 20.0 | 38,000 | 2.0 | 0.012 | 100 | 0.020 | 100 |
| resin A-6 | cyclohexyl methacrylate<br>methacrylic acid | 79.5<br>0.5 | 2-ethylhexyl methacrylate | 3000 | 20.0 | 55,000 | 2.8 | 0.003 | 100 | 0.009 | 100 |
| resin A-7 | cyclohexyl methacrylate<br>methacrylic acid | 99.4<br>0.6 | — | — | — | 62,000 | 3.0 | 0.009 | 100 | 0.018 | 100 |
| resin A-8 | cyclohexyl methacrylate<br>methacrylic acid | 79.4<br>0.6 | methyl methacrylate | 8000 | 20.0 | 65,000 | 3.0 | 0.063 | 100 | 0.102 | 100 |
| resin A-9 | methyl methacrylate<br>methacrylic acid | 79.8<br>0.2 | methyl methacrylate | 7000 | 20.0 | 70,000 | 1.0 | 67.035 | 100 | 24.921 | 100 |
| resin A-10 | cyclohexyl methacrylate<br>methacrylic acid | 78.9<br>1.1 | methyl methacrylate | 6000 | 20.0 | 96,000 | 6.8 | 0.430 | 100 | 0.076 | 100 |
| resin A-11 | methyl methacrylate<br>methacrylic acid | 78.7<br>1.3 | methyl methacrylate | 6000 | 20.0 | 45,000 | 8.8 | 9.801 | 100 | 9.505 | 100 |
| resin A-12 | methyl methacrylate<br>methacrylic acid | 98.5<br>1.5 | — | — | — | 38,000 | 9.3 | 9.716 | 100 | 9.822 | 100 |

TABLE 2

| | monomer | | | | G' from 70° C. to 100° C. | | G'' from 70° C. to 100° C. | |
|---|---|---|---|---|---|---|---|---|
| | constituent monomer | amount of addition (mass %) | Mw | acid value (mg KOH/g) | minimum value ($\times 10^8$ Pa) | tempera-ture (° C.) | minimum value ($\times 10^7$ Pa) | tempera-ture (° C.) |
| resin B-1 | methyl methacrylate | 75.7 | 54,000 | 6.2 | 5.6 | 100 | 7.1 | 85 |
| | n-butyl methacrylate | 23.2 | | | | | | |
| | methacrylic acid | 1.1 | | | | | | |
| resin B-2 | methyl methacrylate | 63.0 | 60,000 | 11.8 | 4.6 | 100 | 6.5 | 80 |
| | n-butyl methacrylate | 35.0 | | | | | | |
| | methacrylic acid | 2.0 | | | | | | |
| resin B-3 | methyl methacrylate | 72.0 | 51,000 | 5.0 | 4.4 | 100 | 5.9 | 80 |
| | n-butyl methacrylate | 27.0 | | | | | | |
| | methacrylic acid | 1.0 | | | | | | |
| resin B-4 | methyl methacrylate | 80.5 | 49,000 | 8.5 | 15.9 | 100 | 9.8 | 70 |
| | tert-butyl methacrylate | 18.0 | | | | | | |
| | methacrylic acid | 1.5 | | | | | | |
| resin B-5 | methyl methacrylate | 85.1 | 47,000 | 9.1 | 1.1 | 100 | 0.5 | 100 |
| | isobutyl methacrylate | 13.3 | | | | | | |
| | acrylic acid | 1.6 | | | | | | |
| resin B-6 | methyl methacrylate | 73.9 | 50,000 | 20.0 | 4.4 | 100 | 7.3 | 80 |
| | n-butyl methacrylate | 22.3 | | | | | | |
| | methacrylic acid | 3.8 | | | | | | |
| resin B-7 | methyl methacrylate | 80.0 | 48,000 | 4.0 | 0.5 | 100 | 0.1 | 80 |
| | isobutyl methacrylate | 19.2 | | | | | | |
| | acrylic acid | 0.8 | | | | | | |
| resin B-8 | methyl methacrylate | 70.5 | 55,000 | 50.0 | 0.6 | 100 | 0.1 | 90 |
| | isobutyl methacrylate | 20.0 | | | | | | |
| | acrylic acid | 9.5 | | | | | | |
| resin B-9 | methyl methacrylate | 70.4 | 55,000 | 51.3 | 0.6 | 100 | 0.1 | 90 |
| | isobutyl methacrylate | 20.0 | | | | | | |
| | acrylic acid | 9.6 | | | | | | |
| resin B-10 | methyl methacrylate | 80.1 | 55,000 | 3.9 | 0.5 | 100 | 0.1 | 90 |
| | isobutyl methacrylate | 19.2 | | | | | | |
| | acrylic acid | 0.7 | | | | | | |
| resin B-11 | methyl methacrylate | 85.8 | 85,000 | 3.9 | 40.5 | 100 | 22.1 | 100 |
| | tert-butyl methacrylate | 13.5 | | | | | | |
| | methacrylic acid | 0.7 | | | | | | |

TABLE 3

| | resin A | | | resin B | | | peak | acid value of | G' from 70° C. to 100° C. | | G'' from 70° C. to 100° C. | |
|---|---|---|---|---|---|---|---|---|---|---|---|---|
| | resin desig-nation | acid value (mg KOH/g) | addi-tion ratio (%) | resin desig-nation | acid value (mg KOH/g) | addi-tion ratio (%) | area ratio for resin A (%) | the coat resin (mg KOH/g) | minimum value ($\times 10^8$ Pa) | tempera-ture (° C.) | minimum value ($\times 10^7$ Pa) | tempera-ture (° C.) |
| coat resin 1 | A-1 | 0.5 | 50 | B-1 | 6.2 | 50 | 50 | 3.4 | 5.50 | 100 | 7.50 | 70 |
| coat resin 2 | A-1 | 0.5 | 60 | B-2 | 11.8 | 40 | 60 | 5.0 | 4.50 | 100 | 6.40 | 70 |
| coat resin 3 | A-1 | 0.5 | 66 | B-3 | 5.0 | 34 | 65 | 2.0 | 4.20 | 100 | 6.00 | 70 |
| coat resin 4 | A-1 | 0.5 | 70 | B-1 | 6.2 | 30 | 69 | 2.2 | 3.10 | 100 | 5.80 | 70 |
| coat resin 5 | A-1 | 0.5 | 30 | B-1 | 6.2 | 70 | 31 | 4.5 | 7.80 | 100 | 8.10 | 70 |
| coat resin 6 | A-2 | 0.8 | 30 | B-1 | 6.2 | 70 | 30 | 4.6 | 0.70 | 100 | 0.10 | 70 |
| coat resin 7 | A-3 | 1.0 | 50 | B-4 | 8.5 | 50 | 51 | 4.8 | 10.00 | 100 | 10.00 | 70 |
| coat resin 8 | A-4 | 1.5 | 50 | B-5 | 9.1 | 50 | 51 | 5.3 | 1.00 | 100 | 0.59 | 70 |
| coat resin 9 | A-5 | 2.0 | 50 | B-1 | 6.2 | 50 | 50 | 4.1 | 0.65 | 100 | 0.097 | 70 |
| coat resin 10 | A-6 | 3.0 | 50 | B-1 | 6.2 | 50 | 50 | 4.6 | 0.51 | 100 | 0.09 | 70 |
| coat resin 11 | A-7 | 3.0 | 50 | B-1 | 6.2 | 50 | 49 | 4.6 | 1.30 | 100 | 0.42 | 70 |
| coat resin 12 | A-8 | 3.1 | 30 | B-5 | 9.1 | 70 | 30 | 7.3 | 8.10 | 100 | 8.50 | 70 |
| coat resin 13 | A-1 | 0.5 | 52 | B-6 | 20.0 | 48 | 53 | 9.9 | 4.30 | 100 | 7.00 | 70 |
| coat resin 14 | A-1 | 0.5 | 88 | B-3 | 5.0 | 12 | 88 | 1.0 | 0.56 | 100 | 0.094 | 70 |
| coat resin 15 | A-1 | 0.5 | 90 | B-6 | 20.0 | 10 | 90 | 2.5 | 0.48 | 100 | 0.089 | 70 |
| coat resin 16 | A-1 | 0.5 | 10 | B-4 | 8.5 | 90 | 10 | 7.7 | 23.00 | 100 | 12.00 | 70 |
| coat resin 17 | A-1 | 0.5 | 86 | B-7 | 4.0 | 14 | 87 | 1.0 | 0.52 | 100 | 0.090 | 70 |
| coat resin 18 | A-1 | 0.5 | 85 | B-8 | 50.0 | 15 | 86 | 7.9 | 0.55 | 100 | 0.092 | 70 |
| coat resin 19 | A-1 | 0.5 | 86 | B-9 | 51.0 | 14 | 87 | 7.6 | 0.57 | 100 | 0.093 | 70 |
| coat resin 20 | A-1 | 0.5 | 82 | B-10 | 3.9 | 18 | 83 | 1.1 | 0.43 | 100 | 0.081 | 70 |
| coat resin 21 | A-1 | 0.5 | 91 | B-9 | 51.0 | 9 | 91 | 5.0 | 0.55 | 100 | 0.092 | 70 |
| coat resin 22 | A-1 | 0.5 | 9 | B-11 | 3.9 | 91 | 9 | 3.6 | 36.00 | 100 | 19.00 | 70 |
| coat resin 23 | A-1 | 0.5 | 90 | B-7 | 4.0 | 10 | 90 | 0.9 | 0.45 | 100 | 0.078 | 70 |
| coat resin 24 | A-1 | 0.5 | 51 | B-6 | 20.0 | 49 | 51 | 10.1 | 0.64 | 100 | 0.091 | 70 |

TABLE 3-continued

| | resin A | | | resin B | | | peak | acid value of | G' from 70° C. to 100° C. | | G'' from 70° C. to 100° C. | |
|---|---|---|---|---|---|---|---|---|---|---|---|---|
| | resin designation | acid value (mg KOH/g) | addition ratio (%) | resin designation | acid value (mg KOH/g) | addition ratio (%) | area ratio for resin A (%) | the coat resin (mg KOH/g) | minimum value ($\times 10^8$ Pa) | temperature (° C.) | minimum value ($\times 10^7$ Pa) | temperature (° C.) |
| coat resin 25 | A-9 | 1.0 | 50 | B-4 | 8.5 | 50 | 52 | 4.8 | 52.90 | 100 | 23.00 | 70 |
| coat resin 26 | A-10 | 6.8 | 100 | — | 0.0 | 0 | 100 | 6.8 | 0.43 | 100 | 0.076 | 100 |
| coat resin 27 | A-11 | 8.8 | 100 | — | 0.0 | 0 | 100 | 8.8 | 9.80 | 100 | 9.50 | 100 |
| coat resin 28 | A-12 | 9.3 | 100 | — | 0.0 | 0 | 100 | 9.3 | 9.70 | 100 | 9.80 | 100 |

TABLE 4

| | magnetic carrier | magnetic carrier core | coat resin: resin designation | coat resin: amount of coat resin (mass parts) | average particle diameter (D50) (μm) |
|---|---|---|---|---|---|
| Example 1 | magnetic carrier 1 | carrier core 1 | coat resin 1 | 2.1 | 39.0 |
| Example 2 | magnetic carrier 2 | carrier core 2 | coat resin 2 | 1.2 | 39.1 |
| Example 3 | magnetic carrier 3 | carrier core 1 | coat resin 3 | 2.1 | 39.1 |
| Example 4 | magnetic carrier 4 | carrier core 1 | coat resin 4 | 2.1 | 39.2 |
| Example 5 | magnetic carrier 5 | carrier core 2 | coat resin 5 | 1.2 | 38.8 |
| Example 6 | magnetic carrier 6 | carrier core 2 | coat resin 6 | 1.2 | 38.9 |
| Example 7 | magnetic carrier 7 | carrier core 2 | coat resin 7 | 1.2 | 38.8 |
| Example 8 | magnetic carrier 8 | carrier core 2 | coat resin 8 | 1.2 | 39.0 |
| Example 9 | magnetic carrier 9 | carrier core 2 | coat resin 9 | 1.2 | 38.9 |
| Example 10 | magnetic carrier 10 | carrier core 2 | coat resin 10 | 1.2 | 38.9 |
| Example 11 | magnetic carrier 11 | carrier core 1 | coat resin 11 | 2.1 | 39.0 |
| Example 12 | magnetic carrier 12 | carrier core 1 | coat resin 12 | 2.1 | 39.1 |
| Example 13 | magnetic carrier 13 | carrier core 2 | coat resin 13 | 1.2 | 39.0 |
| Example 14 | magnetic carrier 14 | carrier core 2 | coat resin 14 | 1.2 | 38.9 |
| Example 15 | magnetic carrier 15 | carrier core 2 | coat resin 15 | 1.2 | 39.1 |
| Example 16 | magnetic carrier 16 | carrier core 2 | coat resin 16 | 1.2 | 39.0 |
| Example 17 | magnetic carrier 17 | carrier core 1 | coat resin 17 | 2.1 | 39.2 |
| Example 18 | magnetic carrier 18 | carrier core 1 | coat resin 18 | 2.1 | 39.2 |
| Comparative Example 1 | magnetic carrier 19 | carrier core 1 | coat resin 19 | 2.1 | 39.1 |
| Comparative Example 2 | magnetic carrier 20 | carrier core 1 | coat resin 20 | 2.1 | 39.0 |
| Comparative Example 3 | magnetic carrier 21 | carrier core 1 | coat resin 21 | 2.1 | 39.1 |
| Comparative Example 4 | magnetic carrier 22 | carrier core 1 | coat resin 22 | 2.1 | 39.2 |
| Comparative Example 5 | magnetic carrier 23 | carrier core 1 | coat resin 23 | 2.1 | 39.0 |
| Comparative Example 6 | magnetic carrier 24 | carrier core 1 | coat resin 24 | 2.1 | 39.1 |
| Comparative Example 7 | magnetic carrier 25 | carrier core 1 | coat resin 25 | 2.1 | 38.9 |
| Comparative Example 8 | magnetic carrier 26 | carrier core 1 | coat resin 26 | 2.1 | 39.0 |
| Comparative Example 9 | magnetic carrier 27 | carrier core 1 | coat resin 27 | 2.1 | 39.1 |
| Comparative Example 10 | magnetic carrier 28 | carrier core 1 | coat resin 28 | 2.1 | 39.0 |

[Toner 1 Production Example]

binder resin (polyester resin): 100 mass parts colorant (C. I. Pigment Blue 15:3): 6.0 mass parts aluminum 1,4-di-t-butylsalicylate compound: 0.5 mass parts normal paraffin wax (melting point: 78° C.): 6.0 mass parts These materials were mixed using a Henschel mixer (product name: Model FM-75J, from Mitsui Mining Co., Ltd.) and were then kneaded (temperature of the kneaded material at discharge=150° C.) at a feed rate of 10 kg/h using a twin-screw kneader (Model PCM-30, from Ikegai Steel Co., Ltd.) set to a temperature of 130° C. The obtained kneaded material was cooled, then coarsely pulverized with a hammer mill, and then finely pulverized with a mechanical pulverizer (product name: T-250, from Turbo Kogyo Co., Ltd.) at a feed rate of 15 kg/hr. Particles with a weight-average particle diameter of 5.5 μm were obtained.

Using a rotary classifier (product name: TTSP100, from Hosokawa Micron Corporation), the obtained particles were subjected to a classification that excluded fines and coarse particles. Doing this yielded a cyan toner particle 1 having a weight-average particle diameter of 6.4 μm.

In addition, the materials listed below were introduced into a Henschel mixer (product name: Model FM-75, from Nippon Coke & Engineering Co., Ltd.) and a cyan toner 1 was obtained by adhering the silica and titanium oxide to the surface of the cyan toner particle 1 by mixing for a mixing time of 3 minutes at a peripheral velocity for the rotating blades of 35.0 m/second.

cyan toner particle 1: 100 mass parts silica (provided by the surface treatment with hexamethyldisilazane, at a 1.5 mass % treatment, of silica fine particles produced by a sol-gel method, followed by adjustment to the desired particle size distribution by classification): 3.5 mass parts titanium oxide (metatitanic acid having the anatase crystal form, surface treated with an octylsilane compound): 0.5 mass parts

Example 1

10 mass parts of cyan toner 1 was added per 90 mass parts of magnetic carrier 1 and 300 g of a two-component developer was prepared by shaking in a shaker (product name: Model YS-8D, from Yayoi Co., Ltd.). The shaking conditions with the shaker were 200 rpm and 2 minutes.

A replenishing developer was also obtained by adding 95 mass parts of cyan toner 1 per 5 mass parts of magnetic carrier 1 and mixing for 5 minutes with a V-mixer in a temperature 23° C./humidity 50% RH (normal temperature, normal humidity) environment (below, the "N/N environment").

The evaluations described below were carried out using this two-component developer and replenishing developer.

A modified version of a full-color copier from Canon, Inc. (product name: imageRUNNER ADVANCE C9075 PRO) was used as the image-forming apparatus.

Image formation was carried out with the two-component developer filled in the developing device for the individual color and with the replenishing developer container filled with replenishing developer for the individual color installed, and the following evaluations were performed while carrying out a durability test.

The durability test was carried out by changing, as indicated below, the environment and the image ratio during the image output of a total of 130,000 prints from Step 1 to Step 5.

Step 1 (from Print Number 1 to Print Number 30,000)
temperature 30° C./humidity 80% RH (below, the "H/H environment")
FFH output chart with an image ratio of 40%
Step 2 (from Print Number 30,001 to Print Number 60,000)
temperature 23° C./humidity 5% RH (below, the "N/L environment")
FFH output chart with an image ratio of 3%
Step 3 (from Print Number 60,001 to Print Number 90,000)
temperature 30° C./humidity 80% RH (below, the "H/H environment")
FFH output chart with an image ratio of 40%
Step 4 (from Print Number 90,001 to Print Number 120,000)
temperature 23° C./humidity 5% RH (below, the "N/L environment")
FFH output chart with an image ratio of 3%
Step 5 (from Print Number 120,001 to Print Number 130,000)
temperature 30° C./humidity 80% RH (below, the "H/H environment")
FFH output chart with an image ratio of 80%

Here, FFH is a value that represents 256 gradations as a hexadecimal number, where 00H represents the 1st gradation (white area) of 256 gradations and FFH is the 256th gradation (solid area) of 256 gradations.

Other conditions are as follows.

Paper: CS-814 (product name) laser printer paper (81.4 g/m$^2$) (Canon Marketing Japan Inc.)

Image-formation speed: modified to enable output at 80 full-color prints/minute in A4 size.

Developing conditions: modified so the development contrast was freely adjustable and automatic correction by the main unit was disabled.

With regard to the peak-to-peak voltage (Vpp) for the alternating electric field, frequency: 2.0 kHz, modified so Vpp could be varied in 0.1 kV steps from 0.7 kV to 1.8 kV.

With respect to each color, modification was made to enable the output of a single-color image.

Each of the evaluated items is indicated in the following.

(1) Fogging (Evaluation S)

After the output of print number 90,000 in Step 3, 10 prints were output of a 00H output chart having an image ratio of 100% (solid white image over the entire A4 area), and the whiteness of the white region was measured with a reflectometer (Tokyo Denshoku Co., Ltd.). The fogging density (%) was calculated from the difference between this whiteness and the whiteness of the transfer paper, and the highest fogging density among the 10 prints was used for the evaluation. The evaluation criteria are as follows.

A: less than 0.4% (very good)
B: from 0.4% to less than 0.8% (good)
C: from 0.8% to less than 1.2% (fair)
D: from 1.2% to less than 1.6% (average)
E: from 1.6% to less than 2.0% (fogging is somewhat conspicuous)
F: 2.0% or greater (fogging is conspicuous)

The levels at which the results of the present invention were obtained were determined to be A to D.

The results are given in Table 5.

(2) Image Density Non-Uniformity (Evaluation T)

After the output of print number 90,000 in Step 3, a single print was output of an FFH output chart with an image ratio of 100% (solid image over the entire A4 area).

The reflection density was determined by measuring the image density using a Series 500 SpectroDensitometer (from X-Rite, Incorporated).

The difference between the highest image density and the lowest image density was determined for a total of 12 measurement locations as follows: 3 points that were located 0.5 cm from the leading edge of the image (direction of previous image formation) and 5.0 cm, 15.0 cm, and 25.0 cm from the left edge of the image (the upper side is the direction of previous image formation);

3 points that were located 7.0 cm from the leading edge of the image and 5.0 cm, 15.0 cm, and 25.0 cm from the left edge of the image;

3 points that were located 14.0 cm from the leading edge of the image and 5.0 cm, 15.0 cm, and 25.0 cm from the left edge of the image; and 3 points that were located 20.0 cm from the leading edge of the image and 5.0 cm, 15.0 cm, and 25.0 cm from the left edge of the image.

The evaluation results are for the largest density difference among 50 prints.

A: less than 0.05 (no density non-uniformity)

B: from 0.05 to less than 0.10 (almost no density non-uniformity, and better than C)

C: from 0.10 to less than 0.15 (almost no density non-uniformity, and better than D)

D: from 0.15 to less than 0.20 (almost no density non-uniformity)

E: from 0.20 to less than 0.25 (density non-uniformity is somewhat conspicuous)

F: 0.25 or greater (density non-uniformity is conspicuous)

The levels at which the results of the present invention were obtained were determined to be A to D.

The results are given in Table 5.

(3) Image Density Differences Pre-Versus-Post-Durability Testing in Individual Steps (Evaluations U, W, and Y)

At the start and end of each step in Step 3, Step 4, and Step 5, one print was output of an FFH output chart having an image ratio of 100% (solid image over the entire A4 area). The reflection density was measured on the output print as in the previously described density non-uniformity, and the average value of the 12 points was calculated.

For the evaluation, the difference between the 12-point average value at the start of the particular step and the 12-point average value at the end of the particular step was scored using the following criteria.

A: from 0.00 to less than 0.04 (no density difference)

B: from 0.04 to less than 0.08 (almost no density difference, and better than C)

C: from 0.08 to less than 0.12 (almost no density difference, and better than D)

D: from 0.12 to less than 0.16 (almost no density difference)

E: from 0.16 to less than 0.20 (the density difference is somewhat conspicuous)

F: 0.20 or greater (the density difference is conspicuous)

The levels at which the results of the present invention were obtained were determined to be A to D.

The results are given in Table 5.

(4) The Image Density Difference after Durability Testing in Step 3 and Step 4 (Evaluation X)

At the end of Step 3 and at the end of Step 4, one print was output of an FFH output chart having an image ratio of 100% (solid image over the entire A4 area). The reflection density was measured on the output print as in the previously described density non-uniformity, and the average value of the 12 points was calculated.

For the evaluation, the difference between the 12-point average value for Step 3 and the 12-point average value for Step 4 was scored using the following criteria.

A: from 0.00 to less than 0.05 (no density difference)

B: from 0.05 to less than 0.10 (almost no density difference, and better than C)

C: from 0.10 to less than 0.15 (almost no density difference, and better than D)

D: from 0.15 to less than 0.20 (almost no density difference)

E: from 0.20 to less than 0.25 (the density difference is somewhat conspicuous)

F: 0.25 or greater (the density difference is conspicuous)

The levels at which the results of the present invention were obtained were determined to be A to D.

The results are given in Table 5.

(5) Evaluation of Carrier Adhesion (Evaluation V)

After the output of print number 120,000 in Step 4, the power was turned off during the process of outputting an image of a 00H output chart having an image ratio of 100% (solid white image over the entire A4 area), and the surface of the electrostatic latent image bearing member (photosensitive member) was sampled, prior to cleaning, by the application of transparent pressure-sensitive tape. The number of magnetic carrier particles adhered to the surface of the electrostatic latent image bearing member in 1 cm×20 cm was counted; the number of adhered carrier particles per 1 $cm^2$ was calculated; and evaluation was performed using the following criteria. The evaluation was carried out with the cyan single color.

A: from 0 to less than 0.5 (very good)

B: from 0.5 to less than 1.0 (good)

C: from 1.0 to less than 1.5 (fair)

D: from 1.5 to less than 2.0 (average)

E: from 2.0 to less than 2.5 (carrier adhesion is somewhat conspicuous)

F: 2.5 or greater (carrier adhesion is conspicuous)

The levels at which the results of the present invention were obtained are A to D.

The results are given in Table 5.

(6) Evaluation of Toner Scattering within the Apparatus (Evaluation Z)

After the completion of the durability test with print number 130,000 in Step 5, the interior of the copier was opened and the status of toner scattering in the interior was inspected. The evaluation criteria were as follows.

A: Slight scattering occurs, but only around the replenishment port.

B: Scattering occurs, but only around the replenishment port.

C: Scattering occurs around the replenishment port and at the periphery in a narrow range.

D: Scattering occurs around the replenishment port and at the periphery.

E: Slight scattering to a portion of the intermediate transfer member.

F: Scattering to a portion of the intermediate transfer member.

The levels at which the results of the present invention were obtained were determined to be A to D. However, regardless of the level, toner scattering to the outside of the copier did not occur at any level. The results are given in Table 5.

(7) Overall Evaluation

The evaluation ranks in Evaluations S through Z were converted into numerical values (A=5, B=4, C=3, D=2, E=1, F=0), and the total values were scored according to the following criteria.

A: from 38 to 40 (very good)

B: from 35 to 37 (good)

C: from 30 to 34 (fair)

D: from 20 to 29 (average)

E: from 10 to 19 (image defects are of some concern)

F: 9 or below (image defect are a concern)

The levels at which the results of the present invention were obtained were determined to be A to D. The results are given in Table 6.

All of the evaluations gave very good results in Example 1. The results of the evaluations are given in Tables 5 and 6.

Example 2 and 3

Proceeding as in Example 1, two-component developers and replenishing developers were produced using magnetic carriers 2 and 3 and the same ratios as in Example 1. The evaluations were performed as in Example 1, but using the obtained developers.

The coat resin in Example 2 had a somewhat higher acid value than in Example 1, and the coat resin in Example 3 had a somewhat lower acid value than in Example 1. While this resulted in the appearance of a minor influence on the evaluation results for Step 5, very good results were otherwise obtained. The results of the evaluations are given in Tables 5 and 6.

Example 4 and 5

Proceeding as in Example 1, two-component developers and replenishing developers were produced using magnetic carriers 4 and 5 and the same ratios as in Example 1. The evaluations were performed as in Example 1, but using the obtained developers.

The ratio for coat resin A was somewhat different in Examples 4 and 5 from that in Example 1. While this resulted in the appearance of a minor influence on the evaluation results for Step 3 and Step 4, very good results were otherwise obtained. The results of the evaluations are given in Tables 5 and 6.

Examples 6 and 7

Proceeding as in Example 1, two-component developers and replenishing developers were produced using magnetic carriers 6 and 7 and the same ratios as in Example 1. The evaluations were performed as in Example 1, but using the obtained developers.

The results for the minimum values of the viscoelastic properties G' and G" from 70° C. to 100° C. were a little lower in Example 6. Some influence on the evaluations in the H/H environment appeared due to a lack of stability for the surface of the resin coat layer caused by softening of the coat resin, but very good results were otherwise obtained. The results of the evaluations are given in Tables 5 and 6.

The results for the minimum values of the viscoelastic properties G' and G" from 70° C. to 100° C. were a little higher in Example 7. Due to a hard coat resin and the production of some non-uniformity in the coating film of the resin coat layer during coating, an influence on the image in Step 3 and some influence on scattering within the apparatus were seen; however, good results were otherwise obtained. The results of the evaluations are given in Tables 5 and 6.

Example 8

Proceeding as in Example 1, a two-component developer and a replenishing developer were produced using magnetic carrier 8 and the same ratios as in Example 1. The evaluations were performed as in Example 1, but using the obtained developers.

The acid value of the coat resin is somewhat higher in Example 8 than in Example 2. The hygroscopicity increases when the coat resin has a higher acid value. The evaluations in the H/H environment were somewhat declined due to the impact of this, but good results were otherwise obtained. The results of the evaluations are given in Tables 5 and 6.

Example 9

Proceeding as in Example 1, a two-component developer and a replenishing developer were produced using magnetic carrier 9 and the same ratios as in Example 1. The evaluations were performed as in Example 1, but using the obtained developers.

The results for the minimum values of the viscoelastic properties G' and G" from 70° C. to 100° C. were somewhat lower in Example 9 than in Example 6. In accordance with these results, the evaluations in the H/H environment were somewhat declined, but good results were otherwise obtained. The results of the evaluations are given in Tables 5 and 6.

Example 10

Proceeding as in Example 1, a two-component developer and a replenishing developer were produced using magnetic carrier 10 and the same ratios as in Example 1. The evaluations were performed as in Example 1, but using the obtained developers.

The acid value of the coat resin A in Example 10 is higher than in Example 9. When, in the present invention, the coat resin A had a high acid value, little effect was obtained with regard to improving the coating film strength of the resin coat layer by blending coat resins A and B. It is thought that, due to this, the coating properties changed as the number of prints in the durability test increased, and an influence appeared on the density difference pre-versus-post-durability testing. In addition, while the evaluation of the scattering within the apparatus was lowered somewhat, unproblematic results were otherwise obtained. The results of the evaluations are given in Tables 5 and 6.

Example 11

Proceeding as in Example 1, a two-component developer and a replenishing developer were produced using magnetic carrier 11 and the same ratios as in Example 1. The evaluations were performed as in Example 1, but using the obtained developers.

A macromonomer was not used in coat resin A in Example 11. This caused the coating film strength of the resin coat layer to decline. Due to the influence of this, the durability declined and an influence on the Step 5 evaluations appeared. The results of the evaluations are given in Tables 5 and 6.

Example 12

Proceeding as in Example 1, a two-component developer and a replenishing developer were produced using magnetic carrier 12 and the same ratios as in Example 1. The evaluations were performed as in Example 1, but using the obtained developers.

The acid value of the coat resin A in Example 12 is higher than in Example 10. When, in the present invention, the coat resin A had a high acid value, there was a reduction in the effect of improving the coating film strength of the resin coat layer through blending, and as a consequence some influence appeared in all of the evaluations and in addition the evaluation of scattering within the apparatus was lowered somewhat. The results of the evaluations are given in Tables 5 and 6.

Example 13

Proceeding as in Example 1, a two-component developer and a replenishing developer were produced using magnetic carrier 13 and the same ratios as in Example 1. The evaluations were performed as in Example 1, but using the obtained developers.

The coat resin has a high acid value in Example 13. The influence of the hygroscopicity was strengthened when the coat resin had a high acid value, and the evaluation levels with regard to environmental differences were declined as a result. The results of the evaluations are given in Tables 5 and 6.

Example 14

Proceeding as in Example 1, a two-component developer and a replenishing developer were produced using magnetic carrier 14 and the same ratios as in Example 1. The evaluations were performed as in Example 1, but using the obtained developers.

The coat resin has a low acid value in Example 14. An influence on the coating film strength of the resin coat layer appeared when the coat resin had a low acid value, and as a result the evaluation levels were declined in the steps in which a large number of prints were made in the durability test. The results of the evaluations are given in Tables 5 and 6.

Example 15

Proceeding as in Example 1, a two-component developer and a replenishing developer were produced using magnetic carrier 15 and the same ratios as in Example 1. The evaluations were performed as in Example 1, but using the obtained developers.

The ratio for the coat resin A was high in Example 15. Due to this, an effect on the coating film strength of the resin coating layer appeared and as a result the evaluation levels were declined in the steps in which a large number of prints were made in the durability test. The level for scattering within the apparatus was declined in particular. The results of the evaluations are given in Tables 5 and 6.

Example 16

Proceeding as in Example 1, a two-component developer and a replenishing developer were produced using magnetic carrier 16 and the same ratios as in Example 1. The evaluations were performed as in Example 1, but using the obtained developers.

The ratio for the coat resin A is low in Example 16. Due to this, a decline in the charge-providing performance was facilitated and the evaluation levels in the H/H environment were lowered. The level for scattering within the apparatus was declined in particular. The results of the evaluations are given in Tables 5 and 6.

Example 17

Proceeding as in Example 1, a two-component developer and a replenishing developer were produced using magnetic carrier 17 and the same ratios as in Example 1. The evaluations were performed as in Example 1, but using the obtained developers.

The coat resin B has a low acid value in Example 17. Due to this, the coating film strength of the resin coat layer was unstable, and the evaluations when long-term durability testing was performed and/or the evaluation levels concerned with environment differences were declined. The results of the evaluations are given in Tables 5 and 6.

Example 18

Proceeding as in Example 1, a two-component developer and a replenishing developer were produced using magnetic carrier 18 and the same ratios as in Example 1. The evaluations were performed as in Example 1, but using the obtained developers.

The coat resin B has a high acid value in Example 18. Due to this, the coating film strength of the resin coat layer was unstable, and the evaluations when long-term durability testing was performed and the evaluation levels concerned with environment differences were declined. The results of the evaluations are given in Tables 5 and 6.

Comparative Example 1

Proceeding as in Example 1, a two-component developer and a replenishing developer were produced using magnetic carrier 19 and the same ratios as in Example 1. The evaluations were performed as in Example 1, but using the obtained developers.

The acid value of the coat resin B is too high in Comparative Example 1, and as a consequence the surface (coating film surface) and strength of the resin coat layer are unstable and, when long-term durability testing is performed, peeling of the resin coat layer readily occurs. Due to this, declined evaluation levels were obtained when long-term durability testing was performed. The results of the evaluations are given in Tables 5 and 6.

Comparative Example 2

Proceeding as in Example 1, a two-component developer and a replenishing developer were produced using magnetic carrier 20 and the same ratios as in Example 1. The evaluations were performed as in Example 1, but using the obtained developers.

The acid value of the coat resin B was too low in Comparative Example 2, and as a consequence the surface (coating film surface) and strength of the resin coat layer were unstable and declined evaluation levels were obtained when long-term durability testing was performed. In addition, density differences in the N/L environment and the amount of carrier adhesion also declined. The results of the evaluations are given in Tables 5 and 6.

Comparative Examples 3 and 4

Proceeding as in Example 1, a two-component developer and a replenishing developer were produced using magnetic carriers 21 and 22 and the same ratios as in Example 1. The evaluations were performed as in Example 1, but using the obtained developers.

Negative effects appear in Comparative Examples 3 and 4 due to the skew in the ratio for the coat resin A.

In Comparative Example 3, the ratio for the coat resin A was too high, and here an adequate coating film strength for the resin coat layer was not obtained and the level for scattering within the apparatus was declined in particular among the evaluations when long-term durability testing was performed.

In Comparative Example 4, the ratio for the coat resin A was too low, and here the surface (coating film surface) of the resin coat layer was unstable and results were obtained in which the evaluations when long-term durability testing was performed were declined and the evaluation levels for density differences were declined. The results of the evaluations are given in Tables 5 and 6.

Comparative Example 5

Proceeding as in Example 1, a two-component developer and a replenishing developer were produced using magnetic carrier 23 and the same ratios as in Example 1. The evaluations were performed as in Example 1, but using the obtained developers.

The acid value of the coat resin is too low in Comparative Example 5. As a result, the surface (coating layer surface) and strength of the resin coat layer were unstable and the evaluation levels when long-term durability testing was performed were declined. In addition, the density differences and the amount of carrier adhesion and density differences in the N/L environment also declined. The results of the evaluations are given in Tables 5 and 6.

Comparative Example 6

Proceeding as in Example 1, a two-component developer and a replenishing developer were produced using magnetic carrier 24 and the same ratios as in Example 1. The evaluations were performed as in Example 1, but using the obtained developers.

The acid value of the coat resin is too large in Comparative Example 6. As a result, the surface (coating layer surface) and strength of the resin coat layer are unstable and, when long-term durability testing is performed, peeling of the resin coat layer readily occurs. As a result, the evaluation levels for the density differences and the environmental differences when long-term durability testing was performed underwent fairly substantial reductions. The results of the evaluations are given in Tables 5 and 6.

Comparative Example 7

Proceeding as in Example 1, a two-component developer and a replenishing developer were produced using magnetic carrier 25 and the same ratios as in Example 1. The evaluations were performed as in Example 1, but using the obtained developers.

Comparative Example 7 is an example in which an alicyclic hydrocarbon group-bearing (meth)acrylate ester monomer is not used in the coat resin. This caused the surface (coating film surface) of the resin coat layer to become fairly unstable and in particular the evaluation levels in the H/H environment were lowered. The results of the evaluations are given in Tables 5 and 6.

Comparative Example 8

Proceeding as in Example 1, a two-component developer and a replenishing developer were produced using magnetic carrier 26 and the same ratios as in Example 1. The evaluations were performed as in Example 1, but using the obtained developers.

Comparative Example 8 is an example that does not use coat resin B while using, in coat resin A, an acrylic resin that has an acid value and that has an alicyclic hydrocarbon group-bearing (meth)acrylate ester monomer. Due to the influence of self-aggregation of the resin, the effects sought for the smoothness of the surface (coating film surface) of the resin coat layer and for the coating film strength of the resin coat layer were not obtained and the evaluation levels for density differences and environmental differences when long-term durability testing was performed were substantially lowered. The results of the evaluations are given in Tables 5 and 6.

Comparative Example 9

Proceeding as in Example 1, a two-component developer and a replenishing developer were produced using magnetic carrier 27 and the same ratios as in Example 1. The evaluations were performed as in Example 1, but using the obtained developers.

Comparative Example 9 is an example that does not use coat resin B while using, for coat resin A, an acrylic resin that has an acid value and that does not use an alicyclic hydrocarbon group-bearing (meth)acrylate ester monomer. As in Comparative Example 8, due to the influence of self-aggregation of the resin, the effects sought for the smoothness of the surface (coating film surface) of the resin coat layer and for the coating film strength of the resin coat layer were not obtained and the evaluation levels from Step 3 on were all declined. The results of the evaluations are given in Tables 5 and 6.

Comparative Example 10

Proceeding as in Example 1, a two-component developer and a replenishing developer were produced using magnetic carrier 28 and the same ratios as in Example 1. The evaluations were performed as in Example 1, but using the obtained developers.

Comparative Example 10 is an example that does not use coat resin B while using, for coat resin A, an acrylic resin that has an acid value and that does not use an alicyclic hydrocarbon group-bearing (meth)acrylate ester monomer and does not use a macromonomer. As in Comparative Examples 8 and 9, due to the influence of self-aggregation of the resin, the effects sought for the smoothness of the surface (coating film surface) of the resin coat layer and for the coating film strength of the resin coat layer were not obtained and the coating film strength of the resin coat layer was also not satisfactory. The evaluation levels from Step 3 on were all declined. The results of the evaluations are given in Tables 5 and 6.

TABLE 5

| | Step; 3 durability in HH environment at 40% image area ratio | | | | | | Step 4 durability in NL environment at 3% image area ratio | | | | density difference in Step 3 and Step 4 | | Step 5 durability in HH environment at 80% image area ratio | | |
|---|---|---|---|---|---|---|---|---|---|---|---|---|---|---|---|
| | S fogging | | T density non-uniformity | | U density difference (%) | | V carrier adhesion | | W density difference (%) | | X density difference (%) | | Y density difference (%) | | Z evaluation |
| | density (%) | evaluation | density (%) | evaluation | density (%) | evaluation | * | evaluation | density (%) | evaluation | density (%) | evaluation | density (%) | evaluation | level for scattering in the apparatus |
| Example 1 | 0.2 | A | 0.02 | A | 0.01 | A | 0.2 | A | 0.01 | A | 0.02 | A | 0.02 | A | A |
| Example 2 | 0.2 | A | 0.03 | A | 0.03 | A | 0.3 | A | 0.03 | A | 0.02 | A | 0.05 | B | A |

TABLE 5-continued

| | Step; 3 durability in HH environment at 40% image area ratio | | | | | | Step 4 durability in NL environment at 3% image area ratio | | | | density difference in Step 3 and Step 4 | | Step 5 durability in HH environment at 80% image area ratio | | |
|---|---|---|---|---|---|---|---|---|---|---|---|---|---|---|---|
| | S fogging | | T density non-uniformity | | U density difference (%) | | V carrier adhesion | | W density difference (%) | | X density difference (%) | | Y density difference (%) | | Z evaluation level for scattering in the apparatus |
| | density (%) | evaluation | density (%) | evaluation | density (%) | evaluation | * | evaluation | density (%) | evaluation | density (%) | evaluation | density (%) | evaluation | |
| Example 3 | 0.2 | A | 0.03 | A | 0.03 | A | 0.4 | A | 0.03 | A | 0.02 | A | 0.03 | A | B |
| Example 4 | 0.3 | A | 0.03 | A | 0.03 | A | 0.4 | A | 0.05 | B | 0.03 | A | 0.03 | A | A |
| Example 5 | 0.3 | A | 0.04 | A | 0.04 | B | 0.4 | A | 0.03 | A | 0.03 | A | 0.03 | A | A |
| Example 6 | 0.3 | A | 0.03 | A | 0.04 | B | 0.4 | A | 0.04 | A | 0.03 | A | 0.05 | B | B |
| Example 7 | 0.3 | A | 0.07 | B | 0.06 | B | 0.7 | B | 0.04 | A | 0.03 | A | 0.03 | A | B |
| Example 8 | 0.4 | B | 0.03 | A | 0.06 | B | 0.4 | A | 0.04 | A | 0.03 | A | 0.04 | B | B |
| Example 9 | 0.5 | B | 0.03 | A | 0.07 | B | 0.4 | A | 0.04 | A | 0.03 | A | 0.05 | B | B |
| Example 10 | 0.3 | A | 0.04 | A | 0.07 | B | 0.6 | B | 0.03 | A | 0.04 | B | 0.05 | B | C |
| Example 11 | 0.3 | A | 0.04 | A | 0.03 | A | 0.7 | B | 0.06 | B | 0.06 | B | 0.09 | C | C |
| Example 12 | 0.5 | B | 0.06 | B | 0.05 | B | 0.7 | B | 0.06 | B | 0.07 | B | 0.07 | B | C |
| Example 13 | 0.6 | B | 0.06 | B | 0.06 | B | 0.8 | B | 0.07 | B | 0.09 | C | 0.09 | C | B |
| Example 14 | 0.6 | B | 0.07 | B | 0.07 | B | 0.9 | B | 0.10 | C | 0.10 | C | 0.10 | C | C |
| Example 15 | 0.7 | B | 0.08 | B | 0.07 | B | 1.1 | C | 0.11 | C | 0.11 | C | 0.07 | B | D |
| Example 16 | 0.8 | C | 0.10 | C | 0.08 | C | 0.9 | B | 0.08 | B | 0.11 | C | 0.09 | C | D |
| Example 17 | 0.8 | C | 0.11 | C | 0.09 | C | 0.9 | B | 0.11 | C | 0.13 | D | 0.13 | D | D |
| Example 18 | 0.8 | C | 0.11 | C | 0.09 | C | 1.3 | C | 0.11 | C | 0.14 | D | 0.14 | D | D |
| Comparative Example 1 | 0.9 | C | 0.16 | D | 0.10 | C | 1.3 | C | 0.12 | C | 0.14 | D | 0.17 | E | E |
| Comparative Example 2 | 1.0 | C | 0.13 | C | 0.10 | C | 1.6 | D | 0.15 | D | 0.11 | C | 0.17 | E | E |
| Comparative Example 3 | 1.0 | C | 0.17 | D | 0.11 | C | 1.6 | D | 0.15 | D | 0.15 | D | 0.17 | E | F |
| Comparative Example 4 | 1.1 | C | 0.18 | D | 0.12 | D | 1.4 | C | 0.15 | D | 0.15 | D | 0.18 | E | F |
| Comparative Example 5 | 1.7 | E | 0.13 | C | 0.09 | C | 1.7 | D | 0.21 | E | 0.15 | D | 0.18 | E | F |
| Comparative Example 6 | 1.1 | C | 0.18 | D | 0.13 | D | 1.7 | D | 0.16 | D | 0.24 | F | 0.21 | F | E |
| Comparative Example 7 | 1.8 | E | 0.18 | D | 0.17 | E | 1.9 | D | 0.18 | D | 0.18 | E | 0.23 | F | E |
| Comparative Example 8 | 1.4 | D | 0.19 | D | 0.15 | D | 2.0 | E | 0.21 | E | 0.23 | F | 0.23 | F | E |
| Comparative Example 9 | 1.8 | E | 0.21 | E | 0.17 | E | 2.1 | E | 0.22 | E | 0.25 | F | 0.24 | F | E |
| Comparative Example 10 | 1.9 | E | 0.22 | E | 0.17 | E | 2.2 | E | 0.22 | E | 0.25 | F | 0.25 | F | F |

* number of adhered carrier particles per 1 $cm^2$

TABLE 6

| | overall evaluation | | | | | | | | | |
|---|---|---|---|---|---|---|---|---|---|---|
| | evaluation S | evaluation T | evaluation U | evaluation V | evaluation W | evaluation X | evaluation Y | evaluation Z | determination index | overall evaluation |
| Example 1 | 5 | 5 | 5 | 5 | 5 | 5 | 5 | 5 | 40 | A |
| Example 2 | 5 | 5 | 5 | 5 | 5 | 5 | 4 | 5 | 39 | A |
| Example 3 | 5 | 5 | 5 | 5 | 5 | 5 | 5 | 4 | 39 | A |
| Example 4 | 5 | 5 | 5 | 5 | 4 | 5 | 5 | 5 | 39 | A |
| Example 5 | 5 | 5 | 4 | 5 | 5 | 5 | 5 | 5 | 39 | A |
| Example 6 | 5 | 5 | 4 | 5 | 5 | 5 | 4 | 4 | 37 | B |
| Example 7 | 5 | 4 | 4 | 4 | 5 | 5 | 5 | 4 | 36 | B |
| Example 8 | 4 | 5 | 4 | 5 | 5 | 5 | 4 | 4 | 36 | B |
| Example 9 | 4 | 5 | 4 | 5 | 5 | 5 | 4 | 4 | 36 | B |
| Example 10 | 5 | 5 | 4 | 4 | 5 | 4 | 4 | 3 | 34 | C |
| Example 11 | 5 | 5 | 5 | 4 | 4 | 4 | 3 | 3 | 33 | C |
| Example 12 | 4 | 4 | 4 | 4 | 4 | 4 | 4 | 3 | 31 | C |
| Example 13 | 4 | 4 | 4 | 4 | 4 | 3 | 3 | 4 | 30 | C |
| Example 14 | 4 | 4 | 4 | 4 | 3 | 3 | 3 | 3 | 28 | D |
| Example 15 | 4 | 4 | 4 | 3 | 3 | 3 | 4 | 2 | 27 | D |
| Example 16 | 3 | 3 | 3 | 4 | 4 | 3 | 3 | 2 | 25 | D |
| Example 17 | 3 | 3 | 3 | 4 | 3 | 2 | 2 | 2 | 22 | D |

TABLE 6-continued

| | overall evaluation | | | | | | | | | |
|---|---|---|---|---|---|---|---|---|---|---|
| | evaluation S | evaluation T | evaluation U | evaluation V | evaluation W | evaluation X | evaluation Y | evaluation Z | determination index | overall evaluation |
| Example 18 | 3 | 3 | 3 | 3 | 3 | 2 | 2 | 2 | 21 | D |
| Comparative Example 1 | 3 | 2 | 3 | 3 | 3 | 2 | 1 | 1 | 18 | E |
| Comparative Example 2 | 3 | 3 | 3 | 2 | 2 | 3 | 1 | 1 | 18 | E |
| Comparative Example 3 | 3 | 2 | 3 | 2 | 2 | 2 | 1 | 0 | 15 | E |
| Comparative Example 4 | 3 | 2 | 2 | 3 | 2 | 2 | 1 | 0 | 15 | E |
| Comparative Example 5 | 1 | 3 | 3 | 2 | 1 | 2 | 1 | 0 | 13 | E |
| Comparative Example 6 | 3 | 2 | 2 | 2 | 2 | 0 | 0 | 1 | 12 | E |
| Comparative Example 7 | 1 | 2 | 1 | 2 | 2 | 1 | 0 | 1 | 10 | E |
| Comparative Example 8 | 2 | 2 | 2 | 1 | 1 | 0 | 0 | 1 | 9 | F |
| Comparative Example 9 | 1 | 1 | 1 | 1 | 1 | 0 | 0 | 1 | 6 | F |
| Comparative Example 10 | 1 | 1 | 1 | 1 | 1 | 0 | 0 | 0 | 5 | F |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-171139, filed Aug. 26, 2014, and Japanese Patent Application No. 2015-161033, filed Aug. 18, 2015, which are hereby incorporated by reference herein in their entirety.

What is claimed is:

1. A magnetic carrier having a magnetic carrier core and a resin coat layer formed on the surface of the magnetic carrier core, wherein the resin coat layer contains a resin component comprising a coat resin A and a coat resin B;

the coat resin A is a polymer having an acid value from 0 to 3.0 KOH/g and that is obtained by polymerization of a (meth)acrylate ester monomer that has an alicyclic hydrocarbon group;

the coat resin B is a polymer comprising a polar group and having an acid value from 4.0 to 50.0 mg KOH/g, that is obtained by polymerization of (meth)acrylic monomer;

the coat resin A is contained in the resin coat layer at from 10 to 90 mass % with reference to the mass of the resin component in the resin coat layer;

the coat resin B is contained in the resin coat layer at from 10 to 90 mass % with reference to the mass of the resin component in the resin coat layer; and the acid value of the resin component in the resin coat layer is from 1.0 to 10.0 mg KOH/g.

2. The magnetic carrier according to claim 1, wherein coat resin A is a polymer obtained by copolymerization of a macromonomer, and a (meth)acrylate ester monomer that has an alicyclic hydrocarbon group, and the macromonomer is obtained by polymerization of at least one monomer selected from the group consisting of methyl acrylate, methyl methacrylate, butyl acrylate, butyl methacrylate, 2-ethylhexyl acrylate, 2-ethylhexyl methacrylate, styrene, acrylonitrile, and methacrylonitrile.

3. The magnetic carrier according to claim 1, wherein a minimum value of a storage elastic modulus (G') of the resin coat layer at from 70° C. to 100° C. is from $7.0\times10^7$ Pa to $1.0\times10^9$ Pa, and a minimum value of a loss elastic modulus (G") of the resin coat layer at rom 70° C. to 100° C. is from $1.0\times10^6$ Pa to $1.0\times10^8$ Pa.

4. The magnetic carrier according to claim 1, wherein the acid value of the resin component in the resin coat layer is from 1.0 mg KOH/g to 5.0 mg KOH/g.

5. A two-component developer having a toner and a magnetic carrier, wherein the magnetic carrier has a magnetic carrier core and a resin coat layer formed on the surface of the magnetic carrier core;

the resin coat layer contains a resin component comprising a coat resin A and a coat resin B;

the coat resin A is a polymer having an acid value from 0 to 3.0 mg KOH/g and that is obtained by polymerization of a (meth)acrylate ester monomer that has an alicyclic hydrocarbon group;

the coat resin B is a polymer comprising a polar group and having an acid value from 4.0 to 50.0 mg KOH/g, that is obtained by polymerization of (meth)acrylic monomer;

the coat resin A is contained in the resin coat layer at from 10 to 90 mass % with reference to the mass of the resin component in the resin coat layer;

the coat resin B is contained in the resin coat layer at from 10 to 90 mass % with reference to the mass of the resin component in the resin coat layer; and the acid value of the resin component in the resin coat layer is from 1.0 to 10.0 mg KOH/g.

6. The two-component developer according to claim 5, wherein coat resin A is a polymer obtained by copolymerization of a macromonomer, and a (meth) acrylate ester monomer that has an alicyclic hydrocarbon group, and the macromonomer is obtained by polymerization of at least one monomer selected from the group consisting of methyl acrylate, methyl methacrylate, butyl acrylate, butyl methacrylate, 2-ethylhexyl acrylate, 2-ethylhexyl methacrylate, styrene, acrylonitrile, and methacrylonitrile.

7. The two-component developer according to claim 5, wherein a minimum value of a storage elastic modulus (G') of the resin coat layer at from 70° C. to 10020 C. is from $7.0\times10^{7}$ Pa to $1.0\times10^{9}$ Pa, and a minimum value of a loss elastic modulus (G") of the resin coat layer at from 70° C. to 100° C. is from $1.0\times10^{6}$ Pa to $1.0\times10^{8}$ Pa.

8. The two-component developer according to claim 5, wherein the acid value of the resin component in the resin coat layer is from 1.0 mg KOH/g to 5.0 mg KOH/g.

* * * * *